US005259897A

United States Patent [19]

Pickens et al.

[11] Patent Number: 5,259,897

[45] Date of Patent: Nov. 9, 1993

[54] ULTRAHIGH STRENGTH AL-CU-LI-MG ALLOYS

[75] Inventors: Joseph R. Pickens, Beltsville; Frank H. Heubaum, Baltimore; Lawrence S. Kramer, Baltimore; Timothy J. Langan, Baltimore, all of Md.

[73] Assignee: Martin Marietta Corporation, Bethesda, Md.

[21] Appl. No.: 327,666

[22] Filed: Mar. 23, 1989

Related U.S. Application Data

[63] Continuation-in-part of Ser. No. 233,705, Aug. 18, 1988, abandoned.

[51] Int. Cl.[5] ..... C22C 21/12

[52] U.S. Cl. ..... 148/417; 420/533; 420/552

[58] Field of Search ..... 420/533, 552; 148/415–418

[56] References Cited

U.S. PATENT DOCUMENTS

| | | | |
|---|---|---|---|
| 2,381,219 | 8/1945 | LeBaron | 75/139 |
| 2,915,391 | 12/1959 | Criner | 75/142 |
| 3,306,717 | 2/1967 | Lindstrand et al. | 29/197 |
| 3,346,370 | 10/1967 | Jagaciak et al. | 75/147 |
| 4,526,630 | 7/1985 | Field | 148/159 |
| 4,584,173 | 4/1986 | Gray et al. | 420/533 |
| 4,588,553 | 5/1986 | Evans et al. | 420/533 |
| 4,594,222 | 6/1986 | Heck et al. | 420/529 |
| 4,603,029 | 7/1986 | Quist et al. | 420/535 |
| 4,624,717 | 11/1986 | Miller | 148/12.7 A |
| 4,626,409 | 12/1986 | Miller | 420/533 |
| 4,629,505 | 12/1986 | Paris | 75/228 |
| 4,648,913 | 3/1987 | Hunt et al. | 148/12.7 A |
| 4,652,314 | 3/1987 | Meyer | 14/2 |
| 4,661,172 | 4/1987 | Skinner et al. | 148/12.7 A |
| 4,752,343 | 6/1988 | DuBost et al. | 148/12.7 A |
| 4,758,286 | 7/1988 | Dubost et al. | 148/12.7 A |
| 4,772,342 | 9/1988 | Polmear | 148/418 |
| 4,795,502 | 1/1989 | Cho | 148/2 |
| 4,832,910 | 5/1989 | Rioja et al. | 420/528 |
| 4,840,683 | 6/1989 | Dubost | 148/12.7 A |
| 4,848,647 | 7/1989 | Gentry et al. | 228/263 |

FOREIGN PATENT DOCUMENTS

| | | | |
|---|---|---|---|
| 0158571 | 10/1985 | European Pat. Off. . | |
| 0158769 | 10/1985 | European Pat. Off. . | |
| 0188762 | 7/1986 | European Pat. Off. . | |
| 0224016 | 6/1987 | European Pat. Off. . | |
| 0227563 | 7/1987 | European Pat. Off. . | |
| 0273600 | 7/1988 | European Pat. Off. . | |
| 3346882 | 6/1984 | Fed. Rep. of Germany . | |
| 2538412 | 6/1984 | France . | |
| 2561261 | 9/1985 | France | 420/533 |
| 0238439 | 11/1985 | Japan . | |
| 1133358 | 6/1986 | Japan . | |
| 1231145 | 10/1986 | Japan . | |
| 8703011 | 5/1987 | PCT Int'l Appl. . | |
| 1172736 | 12/1969 | United Kingdom . | |
| 2121822 | 1/1984 | United Kingdom . | |
| 2134925 | 8/1984 | United Kingdom | 420/552 |

OTHER PUBLICATIONS

Aluminum Alloys: Structure & Properties, L. F. Mondolfo, Boston; Butterworth, 1976, pp. 502, 641, 706–707.

(List continued on next page.)

*Primary Examiner*—Kenneth J. Ramsey

*Attorney, Agent, or Firm*—Gay Chin; Bruce M. Winchell; Herbert W. Mylius

[57] ABSTRACT

Aluminum-base alloys which are provided which possess highly desirable properties, such as relatively low density, high modulus, high strength/ductility combinations, strong natural aging response with and without prior cold work, higher artificially-aged strength than existing Al-Li alloys with and without prior cold work, weldability, good cryogenic properties, and good elevated temperature properties. In one embodiment, aluminum-base alloys are provided having Al-Cu-Li-Mg compositions in the following ranges: 5.0–7.0 Cu, 0.1–2.5 Li, 0.05–4 Mg, 0.01–1.5 grain refiner selected from Zr, Cr, Mn, Ti, Hf, V, Nb, B, $TiB_2$, and mixtures thereof, and the balance essentially Al. In another embodiment, aluminum-base alloys are provided having Al-Cu-Li-Mg compositions in the following ranges: 3.5–5.0 Cu, 0.8–1.8 Li, 0.25–1.0 Mg, 0.01–1.5 grain refiner selected from Zr, Cr, Mn, Ti, Hf, V, Nb, B, $TiB_2$, and mixtures thereof, and the balance essentially Al.

111 Claims, 21 Drawing Sheets

OTHER PUBLICATIONS

"Development of an Experimental Wrought Aluminum Alloy for Use of Elevated Temperatures", Polmear, Aluminum Alloys: Their Physical and Mechanical Properties, E. A. Stark, Jr., & T. H. Sanders, Jr., ed., vol. I. Conf. Proc. U. VA Jun. 15-20, 1986, pp. 661-674, Chameleon.

Marchive & Charue, "Processing & Properties" 4th International Aluminum Lithium Conf., Press. Champier, Dubost, Miannay & Sabetay eds., Proceedings of International Conference, Jun. 10-12, 1987, Pams, France, pp. 43-49.

"First Generation Products-2090" Bretz, Alithalite Alloys:1987 Update; Kar, Agrawal, & Quist, eds., Conference Proceedings of International Aluminum-Lithium Symposium, Los Angelos, Mar. 25-26, 1987, pp. 1-40.

Journal de Physique, vol. 48 No. 9, Sep. 1987, 4th International Aluminum Lithium Conference Jun. 10-12, 1987, Paris, R., edited by Champier et al., publ. by Editions de Physique. Miller et al.; "The Physical Metallurgy of Aluminum-Lithium-Copper-Magnesium-Zirconium Alloys 8090 and 8091"; pp. C3-139 thru C3-149.

Aluminum-Lithium Alloys II, Proceedings of the Second International Aluminum-Lithium Conference, Apr. 12-14, 1983, Monterey Calif., Stark et al., eds., Metallugurical Society of AIME. Kar et al., "Correlation of Microstructures Aging Treatments and Properties of Al-Li-Cu-Mg-Zr I/M and P/M Alloys", pp. 255-285.

Huang & Ardell, "Crystal Structure & Stability of $T_1$ Percepitabs in aged Al-Li-Cu Alloys" Materials Science and Technology, Mar., 1987, vol. 3, pp. 176-188.

Silcock, "The Structural Ageing Characteristics of Aluminum-Copper-Lithium Alloys", Journal of the Institute of Metals, 1959-1960, vol. 88, pp. 357-364.

Aluminum Properties and Physical Metallurgy, Edition 1, 1984, Hatch, Editor; American Society for Metals, Ohio (U.S.), Chapter 5, "Metallurgy of Heat Treatment and general principles of precipitation hardening" pp. 134-139.

Welding Kaiser Aluminum, Edition 2, 1978, Kaiser Aluminum and Chemical Sales, Inc., Calif. (U.S.), Chapter 9, pp. 9-8-9-9.

ULTRAHIGH STRENGTH AL-CU-LI-MG ALLOYS

CROSS REFERENCE TO RELATED APPLICATIONS

This application is a continuation-in-part of U.S. Pat. application Ser. No. 07/233,705, filed Aug. 18, 1988, now abandoned.

FIELD OF THE INVENTION

The present invention relates to Al-Cu-Li-Mg based alloys that have been found to possess extremely desirable properties, such as high artificially-aged strength with and without cold work, strong natural aging response with and without prior cold work, high strength/ductility combinations, low density, and high modulus. In addition, the alloys possess good weldability, corrosion resistance, cryogenic properties and elevated temperature properties. These alloys are particularly suited for aerospace, aircraft, armor, and armored vehicle applications where high specific strength (strength divided by density) is important and a good natural aging response is useful because of the impracticality in many cases of performing a full heat treatment. In addition, the weldability of the present alloys allows for their use in structures which are joined by welding.

In accordance with the present invention, highly improved properties are achieved in Al-Cu-Li-Mg based alloys by providing amounts of Cu, Li and Mg within specified ranges. For Al alloys containing from 5 to 7 weight percent Cu, the amount of Li must be held within the range of from 0.1 to 2.5 weight percent, while the amount of Mg must be limited to from 0.05 to 4 weight percent. For Al alloys containing from 3.5 to 5 weight percent Cu, the Li content must be limited to from 0.8 to 1.8 weight percent, while the Mg content must be held within the range of from 0.25 to 1.0 weight percent. Particular advantage is obtained in accordance with the present invention by providing an Al-Cu-Li-Mg alloy having a high Cu to Li weight percent ratio.

BACKGROUND OF THE INVENTION

The desirable properties of aluminum and its alloys such as low cost, low density, corrosion resistance, and ease of fabrication are well known.

One important means for enhancing the strength of aluminum alloys is heat treatment. Conventionally, three basic steps are employed in the heat treatment of aluminum alloys: (1) Solution heat treating; (2) Quenching; and (3) Aging. Additionally, a cold working step is often added prior to aging. Solution heat treating consists of soaking the alloy at a temperature sufficiently high and for a long enough time to achieve a nearly homogeneous solid solution of precipitate-forming elements in aluminum. The objective is to take into solid solution the maximum practical amounts of the soluble hardening elements. Quenching involves the rapid cooling of the solid solution, formed during the solution heat treatment, to produce a supersaturated solid solution at room temperature. The aging step involves the formation of strengthening precipitates from the rapidly cooled supersaturated solid solution. Precipitates may be formed using natural (ambient temperature), or artificial (elevated temperature) aging techniques. In natural aging, the quenched alloy is held at temperatures in the range of −20° to +50° C., typically at room temperature, for relatively long periods of time. For certain alloy compositions, the precipitation hardening that results from natural aging alone produces useful physical and mechanical properties. In artificial aging, the quenched alloy is held at temperatures typically in the range of 100° to 200° C. for periods of approximately 5 to 48 hours, typically, to effect precipitation hardening.

The extent to which the strength of Al alloys can be increased by heat treatment is related to the type and amount of alloying additions used. The addition of copper to aluminum alloys, up to a certain point, improves strength, and in some instances enhances weldability. The further addition of magnesium to Al-Cu alloys can improve resistance to corrosion, enhance natural aging response without prior cold work and increase strength. However, at relatively low Mg levels, weldability is decreased.

One commercially available aluminum alloy containing both copper and magnesium is alloy 2024, having nominal composition Al - 4.4 Cu - 1.5 Mg - 0.6 Mn. Alloy 2024 is a widely used alloy with high strength, good toughness, good warm temperature properties and a good natural- aging response. However, its corrosion resistance is limited in some tempers, it does not provide the ultrahigh strength and exceptionally strong natural-aging response achievable with the alloys of the present invention, and it is only marginally weldable. In fact, 2024 welded joints are not considered commercially useful in most situations.

Another commercial Al-Cu-Mg alloy is alloy 2519 having a nominal composition of Al - 5.6 Cu - 0.2 Mg - 0.3 Mn - 0.2 Zr - 0.06 Ti - 0.05 V. This alloy was developed by Alcoa as an improvement on 2219, which is presently used in various aerospace applications. While the addition of Mg to the Al-Cu system can enable a natural-aging response without prior cold work, 2519 has only marginally improved strengths over 2219 in the highest strength tempers.

Work reviewed by Mondolfo on conventional Al-Cu-Mg alloys indicates that the main hardening agents are $CuAl_2$ type precipitates in alloys in which the Cu to Mg ratio is greater than 8 to 1 (See ALUMINUM ALLOYS: STRUCTURE AND PROPERTIES, L.F. Mondolfo, Boston: Butterworths, 1976, p. 502).

Polmear, in U.S. Pat. No. 4,772,342, has added silver and magnesium to the Al-Cu system in order to increase elevated temperature properties. A preferred alloy has the composition Al - 6.0 Cu - 0.5 Mg - 0.4 Ag - 0.5 Mn - 0.15 Zr - 0.10 V - 0.05 Si. Polmear associates the observed increase in strength with the "omega phase" that arises in the presence of Mg and Ag (see "Development of an Experimental Wrought Aluminum Alloy for Use at Elevated Temperatures," Polmear, ALUMINUM ALLOYS: THEIR PHYSICAL AND MECHANICAL PROPERTIES, E.A. Starke, Jr. and T.H. Sanders, Jr., editors, Volume I of Conference Proceedings of International Conference, University of Virginia, Charlottesville, Va., Jun. 15–20, 1986, pages 661–674, Chameleon Press, London).

Adding lithium to Al-Mg alloys and to Al-Cu alloys is known to lower the density and increase the elastic modulus, producing significant improvements in specific stiffness and enhancing the artificial age hardening response. However, conventional Al-Li alloys generally possess relatively low ductility at given strength levels and toughness is often lower than desired, thereby limiting their use.

Difficulties in melting and casting have limited the acceptance of Al-Li alloys. For example, because Li is extremely reactive, Al-Li melts can react with the refractory materials in furnace linings. Also, the atmosphere above the melt has to be controlled to reduce oxidation problems. In addition, lithium lowers the thermal conductivity of aluminum, making it more difficult to remove heat from an ingot during direct-chill casting, thereby decreasing casting rates. Furthermore, in Al-Li melts containing 2.2 to 2.7 percent Lithium, typical of recently commercialized Al-Li alloys, there is considerable risk of explosion. To date, the property benefits attributable to these new Al-Li alloys have not been sufficient to offset the increase in processing costs caused by the above-mentioned problems. As a consequence they have not been able to replace conventional alloys such as 2024 and 7075. The preferred alloys of the present invention do not create these melting and casting problems to as great a degree because of their lower Li content.

Al-Li alloys containing Mg are well known, but they typically suffer from low ductility and low toughness. One such system is the low density, weldable Soviet alloy 01420 as disclosed in British Patent 1,172,736, to Fridlyander et al, of nominal composition Al - 5 Mg - 2 Li.

Al-Li alloys containing Cu are also well known, such as alloy 2020, which was developed in the 1950's, but was withdrawn from production because of processing difficulties and low ductility. Alloy 2020 falls within the range disclosed in U.S. Pat. No. 2,381,219 to LeBaron, which emphasizes that the alloys are "magnesium-free", i.e. the alloys have less than 0.01 percent Mg, which is present only as an impurity. In addition, the alloys disclosed by LeBaron require the presence of at least one element selected from Cd, Hg, Ag, Sn, In and Zn. Alloy 2020 has relatively low density, good exfoliation corrosion resistance and stress-corrosion cracking resistance, and retains a useful fraction of its strength at slightly elevated temperatures. However, it suffers from low ductility and low fracture toughness properties in high strength tempers, thereby limiting its usefulness.

To achieve the highest strengths in Al-Cu-Li alloys, it is necessary to introduce a cold working step prior to aging, typically involving rolling and/or stretching of the material at ambient or near ambient temperatures. The strain which is introduced as a result of cold working produces dislocations within the alloy which serve as nucleation sites for the strengthening precipitates. In particular, conventional Al-Cu-Li alloys must be cold worked before artificial aging in order to obtain high strengths, i.e. greater than 70 ksi ultimate tensile strength (UTS). Cold working of these alloys is necessary to promote high volume fractions of $Al_2CuLi$ ($T_1$) and $Al_2Cu$ (theta-prime) precipitates which, due to their high surface-to-volume ratio, nucleate far more readily on dislocations than in the aluminum solid solution matrix. Without the cold working step, the formation of the plate-like $Al_2CuLi$ and $Al_2Cu$ precipitates is retarded, resulting in significantly lower strengths. Moreover, the precipitates do not easily nucleate homogeneously because of the large energy barrier that has to be overcome due to their large surface area. Cold working is also useful, for the same reasons, to produce the highest strengths in many commercial Al-CU alloys, such as 2219.

The requirement for cold working to produce the highest strengths in Al-Cu-Li alloys is particularly limiting in forgings, where it is often difficult to uniformly introduce cold work to the forged part after solutionizing and quenching. As a result, forged Al-Cu-Li alloys are typically limited to non-cold worked tempers, resulting in generally unsatisfactory mechanical properties.

Recently, Al-Li alloys containing both Cu and Mg have been commercialized. These include alloys 8090, 2091, 2090, and CP 276. Alloy 8090, as disclosed in U.S. Pat. No. 4,588,553 to Evans et al, contains 1.0–1.5 Cu, 2.0–2.8,Li, and 0.4–1.0 Mg. The alloy was designed with the following properties for aircraft applications: good exfoliation corrosion resistance, good damage tolerance, and a mechanical strength greater than or equal to 2024 in T3 and T4 conditions. Alloy 8090 does exhibit a natural aging response without prior cold work, but not nearly as strong as that of the alloys of the present invention. In addition, 8090-T6 forgings have been found to possess a low transverse elongation of 2.5 percent.

Alloy 2091, with 1.5–3.4 Cu, 1.7–2.9 Li, and 1.2–2.7 Mg, was designed as a high strength, high ductility alloy. However, at heat treated conditions that produce maximum strength, ductility is relatively low in the short transverse direction.

In recent work on alloys 8090 and 2091, Marchive and Charue have reported reasonably high longitudinal tensile strengths (see "Processing and Properties 4TH INTERNATIONAL ALUMINIUM LITHIUM CONFERENCE, G. Champier, B. Dubost, D. Miannay, and L. Sabetay editors, Proceedings of International Conference, Jun. 10–12, 1987, Paris, France, pp. 43–49). In the T6 temper, 8090 possesses a yield strength of 67.3 ksi and an ultimate tensile strength of 74 ksi, while 2091 possesses a yield strength of 63.8 ksi and an ultimate tensile strength of 75.4 ksi. However, the strengths of both 8090-T6 and 2091-T6 forgings are still below those obtained in the T8 temper, e.g. for 8090-T851 extrusions, tensile properties are 77.6 ksi YS and 84.1 ksi UTS, while for 2091-T851 extrusions, tensile properties are 73.3 ksi YS and 84.1 ksi UTS. By contrast, the Al-Cu-Li-Mg alloys of the present invention possess highly improved properties compared to conventional 8090 and 2091 alloys in both cold worked and non-cold worked tempers.

Alloy 2090, which may contain only minor amounts of Mg, comprises 2.4–3.0 Cu, 1.9–2.6 Li and 0–0.25 Mg. The alloy was designed as a low-density replacement for high strength products such as 2024 and 7075. However, it has weldment strengths that are lower than those of conventional weldable alloys such as 2219 which possesses weld strengths of 35–40 ksi. As cited in the following reference, in the T6 temper alloy 2090 cannot consistently meet the strength, toughness, and stress-corrosion cracking resistance of 7075-T73 (see "First Generation Products- 2090, " Bretz, ALITHALITE ALLOYS: 1987 UPDATE, J. Kar, S.P. Agrawal, W.E. Quist, editors, Conference Proceedings of International Aluminum-Lithium Symposium, Los Angeles, Calif., Mar. 25–26, 1987, pages 1–40). As a consequence, the properties of current Al-Cu-Li alloy 2090 forgings are not sufficiently high to justify their use in place of existing 7XXX forging alloys.

It should be noted that the addition of Mg to the Al-Cu-Li system does not in its own right cause an increase in alloy strength in high strength tempers. For example alloy 8090 (nominal composition Al - 1.3 Cu - 2.5 Li - 0.7 Mg) does not have significantly greater strength compared to nominally Mg-free alloy 2090 (nominal composition Al - 2.7 Cu - 2.2 Li - 0.12 Zr).

Furthermore, Mg-free alloy 2020 of nominal composition Al - 4.5 Cu - 1.1 Li - 0.4 Mn - 0.2 Cd is even slightly stronger than Mg containing alloy 8090.

Several patent documents relating to Al-Cu-Li-Mg alloys exist. European Patent No. 158,571 to Dubost, assigned to Cegedur Societe de Transformation de l'Aluminum Pechiney, relates to Al alloys comprising 2.75–3.5 Cu, 1.9–2.7 Li, 0.1–0.8 Mg, balance Al and grain refiners. The alloys, which are commercially known as CP 276, are said to possess high mechanical strength combined with a decrease in density of 6–9 percent compared with conventional 2xxx (Al-Cu) and 7xxx (Al-Zn-Mg) alloys. The compositional ranges disclosed by Dubost are outside of the ranges of the present invention. Specifically, Dubost's Li content is higher than the Li content of the alloys of the present invention containing less than about 5 percent Cu. Such high levels of Li are required by Dubost in order to lower density over that of conventional alloys. In addition, the maximum Cu level of 3.5 percent given by Dubost is below the preferred Cu level of the present invention. Limiting Cu content to a maximum of 3.5 percent also serves to minimize density in the alloys of Dubost. While Dubost lists high yield strengths of 498–591 MPa (72–85 ksi) for his alloys in the T6 condition, the elongations achieved are relatively low (2.5–5.5 percent).

U.S. Pat. No. 4,752,343 to Dubost et al, assigned to Cegedur Sodiete de Transformation de l'Aluminum Pechiney, relates to Al alloys comprising 1.5–3.4 Cu, 1.7–2.9 Li, 1.2–2.7 Mg , balance Al and grain refiners. The ratio of Mg to Cu must be between 0.5 and 0.8. The alloys are said to possess mechanical strength and ductility characteristics equivalent to conventional 2xxx and 7xxx alloys. The compositional ranges disclosed by Dubost et al are outside of the ranges of the present invention. For example, the maximum Cu content listed by Dubost et al is lower than the minimum Cu level of the present invention. Additionally, the minimum Mg content of Dubost et al is higher than the maximum Mg level permitted in the present alloys containing less than about 5 percent Cu. Further, the minimum Mg to Cu ratio of 0.5 permitted by Dubost et al is far above the Mg/Cu ratio of the present alloys. While the purpose of Dubost et al is to produce alloys having mechanical strengths and ductilities comparable to conventional alloys, such as 2024 and 7475, the actual strength/ ductility combinations achieved are below those attained by the alloys of the present invention.

U.S. Pat. No. 4,652,314 to Meyer, assigned to Cegedur Societe de Transformation de l'Aluminum Pechiney, is directed to a method of heat treating Al-Cu-Li-Mg alloys. The process is said to impart a high level of ductility and isotropy in the final product. While Meyer teaches that his heat treating method is applicable to Al-Cu-Li-Mg alloys, the specific compositions disclosed by Meyer are outside of the compositional ranges of the present invention. Also, the properties which Meyer achieves are below those of the present invention. For example, the highest yield strength achieved by Meyer is 504 MPa (73 ksi) for a cold worked, artificially aged alloy in the longitudinal direction, which is significantly below the yield strengths attained in the alloys of the present invention in the cold worked, artificially aged condition.

U.S. Pat. No. 4,526,630 to Field, assigned to Alcan International Ltd., relates to a method of heat treating Al-Li alloys containing Cu and/or Mg. The process, which constitutes a modification of conventional homogenization techniques, involves heating an ingot to a temperature of at least 530° C. and maintaining the temperature until the solid intermetallic phases present within the alloy enter into solid solution. The ingot is then cooled to form a product which is suitable for further thermomechanical treatment, such as rolling, extrusion or forging. The process disclosed is said to eliminate undesirable phases from the ingot, such as the coarse copper-bearing phase present in prior art Al-Li-Cu-Mg alloys. Field teaches that his homogenization treatment is limited to Al-Li alloys having compositions within specified ranges. For known Al-Li-Cu-Mg based alloys, compositions are limited to 1–3 Li, 0.5–2 Cu, and 0.2–2 Mg. For conventional Al-Li-Mg based alloys, compositions are limited to 1–3 Li, 2–4 Mg, and below 0.1 Cu. For known Al-Li-Cu based alloys, compositions are limited to 1–3 Li, 0.5–4 Cu, and up to 0.2 Mg. The alloys of the present invention do not fall within any of these compositional ranges disclosed by Field. Furthermore, the present alloys possess superior properties, such as increased strength, compared to the properties disclosed by Field.

The following references disclose additional Al, Cu, Li and Mg containing alloys having compositional ranges that are outside of the ranges of the present invention: U.S. Pat. No. 3,306,717 to Lindstrand et al; U.S. Pat. No. 3,346,370 to Jagaciak et al; U.S. Pat. No. 4,584,173 to Gray et al; U.S. Pat. No. 4,603,029 to Quist et al; U.S. Pat. No. 4,626,409 to Miller; U.S. Pat. No. 4,661,172 to Skinner et al; U.S. Pat. No. 4,758,286 to Dubost et al; European Patent Application Publication No. 0188762 to Hunt et al; European Patent Application Publication No. 0149193; Japanese Pat. No. J6-0238439; Japanese Pat. No. J6-1133358; and Japanese Pat. No. J6-1231145.

There are a limited number of references relating to Al-Cu-Li-Mg alloys that disclose amounts of Cu of to 5 percent. None of these references disclose the specific alloy compositions of the present invention, nor do they disclose the highly desirable properties which the alloys of the present invention have been found to possess. In addition, none of these references disclose the necessity of the high Cu to Li ratio required in the alloys of the present invention. While each of the-following references disclose broad ranges of Cu, Li and Mg that may be alloyed with Al, none of these references disclose the critical ranges and combinations of Cu, Li and Mg of the present invention which produce alloys having physical and mechanical properties that heretofore have not been achieved.

U.S. Pat. No. 4,648,913 to Hunt et al, assigned to Alcoa, relates to a method of cold working Al-Li alloys wherein solution heat treated and quenched alloys are subjected to greater than 3 percent stretch at room temperature. The alloy is then artificially aged to produce a final alloy product. The cold work imparted by the process of Hunt et al is said to increase strength while causing little or no decrease in fracture toughness of the alloys. The particular alloys utilized by Hunt et al are chosen such that they are responsive to the cold working and aging treatment disclosed. That is, the alloys must exhibit improved strength with minimal loss in fracture toughness when subjected to the cold working treatment recited (greater than 3 percent stretch) in contrast to the result obtained with the same alloy if cold worked less than 3 percent. Hunt et al broadly recite ranges of alloying elements which, when combined with Al, may produce alloys that are responsive to greater than 3 percent stretch. The disclosed ranges are 0.5–4.0 Li, 0–5.0 Mg, up to 5.0 Cu, 0–1.0 Zr, 0–2.0 Mn, 0–7.0 Zn, balance Al. While Hunt et al disclose very broad ranges of several alloying elements, there is only a limited range of alloy compositions that would actually exhibit the required combination of improved strength and retained fracture toughness when subjected to greater than 3 percent stretch. Particularly, the alloy compositions of the present invention do not exhibit the response to cold working which is required by Hunt et al. Rather, the strengths achieved in the alloys of the present invention remain substantially constant when subjected to varying amounts of stretch. Thus, the alloys of the present invention are distinct from, and possess advantages over, the alloys contemplated by Hunt et al, because large amounts of cold work are not required to achieve improved properties. In addition, the yield strengths which Hunt et al achieve in the alloy compositions disclosed are substantially below those which are attained in the alloys of the present invention. Further, Hunt et al indicate that it is preferred in their process to artificially age the alloy after cold working, rather than to naturally age. In contrast, the alloys of the present invention exhibit an extremely strong natural aging response, providing high elongations and only slightly lower strengths than in the artificially aged tempers.

U.S. Pat. No. 4,795,502 to Cho, assigned to Alcoa, is directed to a method of producing unrecrystallized wrought Al-Li sheet products having improved levels of strength and fracture toughness. In the process of Cho, a homogenized aluminum alloy ingot is hot rolled at least once, cold rolled, and subjected to a controlled reheat treatment. The reheated product is then solution heat treated, quenched, cold worked to induce the equivalent of greater than 3 percent stretch, and artificially aged to provide a substantially unrecrystallized sheet product having improved levels of strength and fracture toughness. The final product is characterized by a highly worked microstructure which lacks well-developed grains. The Cho reference appears to be a modification of the Hunt et al reference listed above, in that a controlled reheat treatment is added prior to solution heat treatment which prevents recrystallization in the final product formed. Cho discloses that aluminum base alloys within the following compositional ranges are suitable for the recited process: 1.6–2.8 Cu, 1.5–2.5 Li, 0.7–2.5 Mg, and 0.03–0.2 Zr. These ranges are outside of the compositional ranges of the present invention. For example, the maximum Cu level of 2.8 percent listed by Cho is well below the minimum Cu level of the present invention. However, Cho then goes on to broadly state that the alloy of his invention can contain 0.5–4.0 Li, 0–5.0 Mg, up to 5.0 Cu, 0–1.0 Zr, 0–2.0 Mn, and 0–7.0 Zn. As in the Hunt et al reference, the particular alloys utilized by Cho are apparently chosen such that they exhibit a combination of improved strength and fracture toughness when subjected to greater than 3 percent cold work. The alloys of Cho must further be susceptible to the reheat treatment recited. As discussed above, the alloys of the present invention attain essentially the same ultra-high strength with varying amounts of stretch and do not require cold work to obtain their extremely high strengths. While Cho provides a process which is said to improve strength in known Al-Li alloys, such as 2091, the strengths attained are substantially below those achieved in the alloys of the present invention. Cho also indicates that artificial aging should be used in his process to obtain advantageous properties. In contrast, the alloys of the present invention do not require artificial aging. Rather, the present alloys exhibit an extremely strong natural aging response which permits their use in applications where artificial aging is impractical. It can therefore be seen that the alloys of the present invention are distinct from the alloys amenable to the process taught by Cho.

European Patent Application No. 227,563, to Meyer et al, assigned to Cegedur Societe de Transformation de l'Aluminum Pechiney, relates to a method of heat treating conventional Al-Li alloys to improve exfoliation corrosion resistance while maintaining high mechanical strength. The process involves the steps of homogenization, extrusion, solution heat treatment and cold working of an Al-Li alloy, followed by a final tempering step which is said to impart greater exfoliation corrosion resistance to the alloy, while maintaining high mechanical strength and good resistance to damage. Alloys subjected to the treatment have a sensitivity to the EXCO exfoliation test of less than or equal to EB (corresponding to good behavior in natural atmosphere) and a mechanical strength comparable with 2024 alloys. Meyer et al list broad ranges of alloying elements which, when combined with Al, can produce alloys that may be subjected to the final tempering treatment disclosed. The ranges listed include 1–4 Li, 0–5 Cu, and 0–7 Mg. While the reference lists very broad ranges of alloying elements, the actual alloys which Meyer et al utilize are the conventional alloys 8090, 2091, and CP276. Thus, Meyer et al do not teach the formation of new alloy compositions, but merely teach a method of processing known Al-Li alloys. The highest yield strength achieved in accordance with the process of Meyer et al is 525 MPa (76 ksi) for alloy CP276 (2.0 Li, 3.2 Cu, 0.3 Mg, 0.11 Zr, 0.04 Fe, 0.04 Si, balance Al) in the cold worked, artificially aged condition. This maximum yield strength listed by Meyer et al is below the yield strengths achieved in the alloys of the present invention in the cold worked, artificially aged condition. In addition, the final tempering method of Meyer et al is said to improve exfoliation corrosion resistance in Al-Li alloys, whereby sensitivity to the EXCO exfoliation corrosion test is improved to a rating of less than or equal to EB. In contrast, the alloys of the present invention possess an exfoliation corrosion resistance rating of less than or equal to EB without the use of a final tempering step. The present alloys are therefore distinct from, and advantageous over, the alloys contemplated by Meyer et al, because a final tempering treatment is not required in order to achieve favorable exfoliation corrosion properties.

U.K. Patent Application No. 2,134,925, assigned to Sumitomo Light Metal Industries Ltd., is directed to Al-Li alloys having high electrical resistivity. The alloys are suitable for use in structural applications, such as linear motor vehicles and nuclear fusion reactors, where large induced electrical currents are developed. The primary function of Li in the alloys of Sumimoto is to increase electrical resistivity. The reference lists broad ranges of alloying elements which, when combined with Al, may produce structural alloys having increased electrical resistivity. The disclosed ranges are 1.0–5.0 Li, one or more grain refiners selected from Ti, Cr, Zr, V and W, and the balance Al. The alloy may further include 0–5.0 Mn and/or 0.05–5.0 Cu and/or 0.05–8.0 Mg. Sumitomo discloses particular Al-Li-Cu and Al-Li-Mg based alloy compositions which are said to possess the improved electrical properties. In addition, Sumitomo discloses one Al-Li-Cu-Mg alloy of the composition 2.7 Li, 2.4 Cu, 2.2 Mg, 0.1 Cr, 0.06 Ti, 0.14 Zr, balance aluminum, which possesses the desired increase in electrical resistivity. The Li and Cu levels given for this alloy are outside of the Li and Cu ranges of the present invention. Additionally, the Mg level given is outside of the preferred Mg range of the present invention. The strengths disclosed by Sumitomo are far below those achieved in the present invention. For example, in the Al-Li-Cu based alloys listed, Sumitomo gives tensile strengths of about 17–35 kg/mm2 (24–50 ksi). In the Al-Li-Mg based alloys listed, Sumitomo discloses tensile strengths of about 43–52 kg/mm2 (61–74 ksi). It is desired in Sumitomo to produce alloys having the highest possible strengths in order to produce alloys for the structural applications disclosed. However, since the strengths actually achieved in the reference are well below the strengths attained in the alloys of the present invention, it is evident that Sumitomo has neither discovered nor considered the specific alloys of the present invention.

It should be noted that prior art Al-Cu-Li-Mg alloys have almost invariably limited the amount of Cu to 5 weight percent maximum due to the known detrimental effects of higher Cu content, such as increased density. According to Mondolfo, amounts of Cu above 5 weight percent do not increase strength, tend to decrease fracture toughness, and reduce corrosion resistance (Mondolfo, pp. 706–707.) These effects are thought to arise because in Al-Cu engineering alloys, the practical solid solubility limit of Cu is approximately 5 weight percent, and hence any Cu present above about 5 weight percent forms the less desired primary theta-phase. Moreover, Mondolfo states that in the quaternary system Al-Cu-Li-Mg the Cu solubility is further reduced. He concludes, "The solid solubilities of Cu and Mg are reduced by Li, and the solid solubilities of Cu and Li are reduced by Mg, thus reducing the age hardening and the UTS obtainable." (Mondolfo, p. 641). Thus, the additional Cu should not be taken into solid solution during solution heat treatment and cannot enhance precipitation strengthening, and the presence of the insoluble theta-phase lowers toughness and corrosion resistance.

One reference that teaches the use of greater than 5 percent Cu is U.S. Pat. No. 2,915,391 to Criner, assigned to Alcoa. The reference discloses Al-Cu-Mn base alloys containing Li, Mg, and Cd with up to 9 weight percent Cu. Criner teaches that Mn is essential for developing high strength at elevated temperatures and that Cd, in combination with Mg and Li, is essential for strengthening the Al-Cu-Mn system. Criner does not achieve properties comparable to those of the present invention, i.e. ultra high strength, strong natural aging response, high ductility at several technologically useful strength levels, weldability, resistance to stress corrosion cracking, etc.

Copending U.S. Pat. application Ser. No. 07/83,333, of Pickens et al, filed Aug. 10, 1987, discloses an Al-Cu-Mg-Li-Ag alloy with compositions in the following broad range: 0–9.79 Cu, 0.05–4.1 Li, 0.01–9.8 Mg, 0.01–2.0 Ag, 0.05–1.0 grain refiner, and the balance Al. Specific alloys within these ranges possess extremely high strengths, which appear to be due in part to the presence of silver-containing precipitates.

Copending U.S. Pat. application Ser. No. 07/233,705 of Pickens et al, filed Aug. 18, 1988, of which this application is a continuation-in-part, discloses Al-Cu-Mg-Li alloys with compositions in the following broad range: 5.0–7.0 Cu, 0.1–2.5 Li, 0.05–4 Mg, 0.01–1.5 grain refiner, and the balance Al. The present invention encompasses the ranges disclosed in the parent application. In addition, the present invention encompasses an embodiment to alloys comprising lower amounts of Cu, i.e. 3.5–5.0 percent, in which the levels of Li and Mg are held within narrow limits. The lower Cu embodiment of the present invention represents a group of alloys which have been found to possess highly improved properties over prior art Al-Cu-Li-Mg alloys. Thus, the present invention encompasses a family of alloys which exhibit improved properties compared to conventional alloys. For example, the present alloys possess improved strengths in both cold worked and non-cold worked tempers. In addition, the present alloys exhibit an extremely strong natural aging response. Further, the alloys have high strength/ductility combinations, low density, high modulus, good weldability, good corrosion resistance, improved cryogenic properties and improved elevated temperature properties.

SUMMARY OF THE INVENTION

An object of the present invention is to provide a novel aluminum-base alloy composition.

A further object of the present invention is to provide an Al-Li alloy with outstanding naturally aged properties both with (T3) and without (T4) cold work, including high ductility, weldability, excellent cryogenic properties, and good elevated temperature properties.

A further object of the present invention is to provide an Al-Li alloy with outstanding T8 properties, such as ultrahigh strength in combination with high ductility, weldability, excellent cryogenic properties, good high temperature properties, and good resistance to stress-corrosion cracking.

A further object of the present invention is to provide an Al-Li alloy with substantially improved properties in the non-cold worked, artificially aged T6 temper, such as ultra high strength in combination with high ductility, weldability, excellent cryogenic properties, and good high temperature properties.

It is a further object of the present invention to provide an Al-Cu-Li-Mg alloy having a composition within the following ranges: 3.5–5 Cu, 0.8–1.8 Li, 0.25–1.0 Mg, 0.01–1.5 grain refiner selected from Zr, Cr, Mn, Ti, Hf, V, Nb, B, $TiB_2$ and combinations thereof, and the balance aluminum.

A further object of the present invention is to provide an Al-Cu-Li-Mg alloy having a composition within the following ranges: 5–7 Cu, 0.1–2.5 Li, 0.05–4 Mg, 0.01–1.5 grain refiner selected from Zr, Cr, Mn, Ti, Hf, V, Nb, B, $TiB_2$ and combinations thereof, and the balance aluminum.

It is a further object of the present invention to provide an Al-Cu-Li-Mg alloy having a composition within the following ranges: 3.5–7 Cu, 0.8–1.8 Li, 0.25–1.0 Mg, 0.01–1.5 grain refiner selected from Zr, Cr, Mn, Ti, Hf, V, Nb, B, $TiB_2$ and combinations thereof, and the balance aluminum.

It is a further object of the present invention to provide an Al-Cu-Li-Mg alloy in which the weight percent ratio of Cu to Li is greater than 2.5 and preferably greater than 3.0.

Unless stated otherwise, all compositions are in weight percent.

Figure 1A:
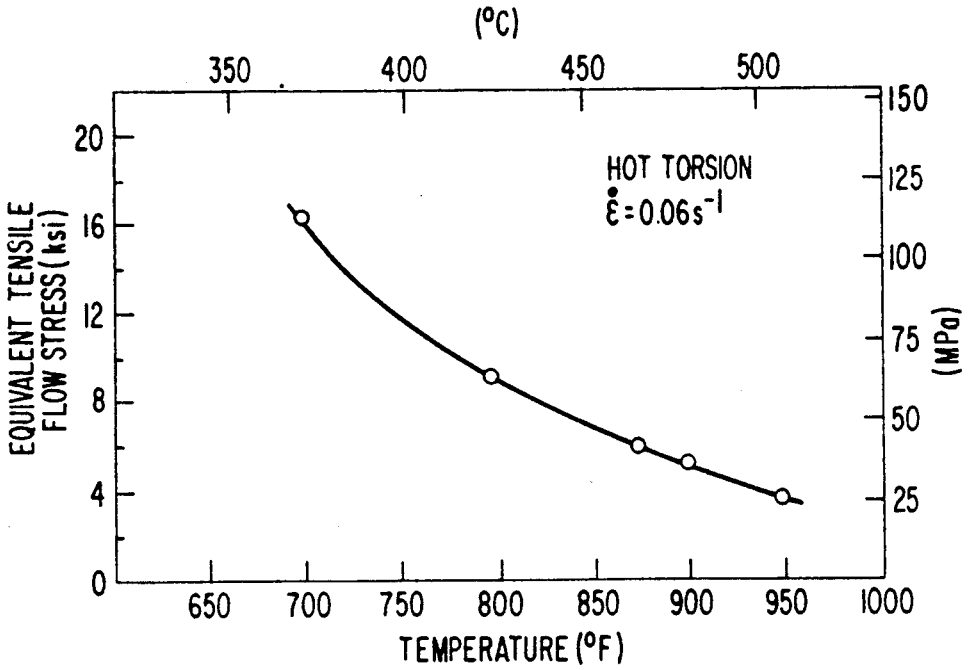
FIGS. 1A-1B shows hot torsion data for Composition I.

E14 low temperature strength and elogation properties vs. aging time for Composition I in the T8 temper.

E15 tensile strength and elogation properties vs. temperature for Composition I in the T8 temper.

DETAILED DESCRIPTION OF THE INVENTION

The alloys of the present invention contain the elements Al, Cu, Li, Mg and a grain refiner or combination of grain refiners selected from the group consisting of Zr, Ti, Cr, Mn, B, Nb, V, Hf and $TiB_2$.

In one embodiment of the invention, an Al-Cu-Li-Mg alloy has a composition within the following ranges: 5.0–7.0 Cu, 0.1–2.5 Li, 0.05–4 Mg, 0.01–1.5 grain refiner(s), with the balance being essentially Al. Preferred ranges are: 5.0–6.5 Cu, 0.5–2.0 Li, 0.2–1.5 Mg, 0.05–0.5 grain refiner(s), and the balance essentially Al. More preferred ranges are: 5.2–6.5 Cu, 0.8–1.8 Li, 0.25–1.0 Mg, 0.05–0.5 grain refiner(s). The most preferred ranges are: 5.4–6.3 Cu, 1.0–1.4 Li, 0.3–0.5 Mg, 0.08–0.2 grain refiner(s) and the balance essentially Al (see Table I).

In another embodiment of the invention, an Al-Cu-Li-Mg alloy has a composition within the following ranges: 3.5–5.0 Cu, 0.8–1.8 Li, 0.25–1.0 Mg, 0.01–1.5 grain refiner(s), with the balance being essentially Al. Preferred ranges are: 3.5–5.0 Cu, 1.0–1.4 Li, 0.3–0.5 Mg, 0.05–0.5 grain refiner(s), and the balance essentially Al. The more preferred ranges are: 4.0–5.0 Cu, 1.0–1.4 Li, 0.3–0.5 Mg, 0.08–0.2 grain refiner(s), with the balance essentially Al. The most preferred ranges are: 4.5–5.0 Cu, 1.0–1.4 Li, 0.3–0.5 Mg, 0.08–0.2 grain refiner(s) and the balance essentially Al (see Table Ia). As stated above, all percentages herein are by weight percent based on the total weight of the alloy., unless otherwise indicated.

Incidental impurities associated with aluminum such as Si and Fe may be present, especially when the alloy has been cast, rolled, forged, extruded, pressed or otherwise worked and then heat treated. Ancillary elements such as Ge, Sn, Cd, In, Be, Sr, Ca and Zn may be added, singly or in combination, in amounts of from about 0.01 to about 1.5 weight percent, to aid, for example, in nucleation and refinement of the precipitates.

TABLE 1

COMPOSITIONS (HIGH COPPER RANGE)

| | Cu Weight Percent | Li Weight Percent | Mg Weight Percent | Grain Refiner* Weight Percent | Al |
|---|---|---|---|---|---|
| Broad | 5.0–7.0 | 0.1–2.5 | 0.05–4 | 0.01–1.5 | Bal. |
| Preferred | 5.0–6.5 | 0.5–2.0 | 0.2–1.5 | 0.05–0.5 | Bal. |
| More Preferred | 5.2–6.5 | 0.8–1.8 | 0.25–1.0 | 0.05–0.5 | Bal. |
| Most Preferred | 5.4–6.3 | 1.0–1.4 | 0.3–0.5 | 0.08–0.2 | Bal. |

*To be selected from 1 or more of the following alone or in combination: Zr, Ti, Cr, Hf, Nb, B, $TiB_2$, V, and Mn.

| | Cu Weight Percent | Li Weight Percent | Mg Weight Percent | Grain Refiner* Weight Percent | Al |
|---|---|---|---|---|---|
| Broad | 3.5–5.0 | 0.8–1.8 | 0.25–1.0 | 0.01–1.5 | Bal. |
| Preferred | 3.5–5.0 | 1.0–1.4 | 0.3–0.5 | 0.05–0.5 | Bal. |
| More Preferred | 4.0–5.0 | 1.0–1.4 | 0.3–0.5 | 0.08–0.2 | Bal. |
| Most Preferred | 4.5–5.0 | 1.0–1.4 | 0.3–0.5 | 0.08–0.2 | Bal. |

*To be selected from 1 or more of the following alone or in combination: Zr, Ti, Cr, Hf, Nb, B, $TiB_2$, V, and Mn.

In accordance with the parameters of the present invention, several alloys were prepared having the following compositions, as set forth in Table II.

TABLE II

Nominal Compositions of Experimental Alloys (wt %)

| Comp. | Cu | Li | Mg | Zr | Al |
|---|---|---|---|---|---|
| I | 6.3 | 1.3 | 0.4 | 0.14 | balance |
| II | 6.3 | 1.3 | 0.2 | 0.14 | balance |
| III | 6.3 | 1.3 | 0.6 | 0.14 | balance |

TABLE II-continued

| Nominal Compositions of Experimental Alloys (wt %) | | | | | |
|---|---|---|---|---|---|
| Comp. | Cu | Li | Mg | Zr | Al |
| IV | 5.4 | 1.3 | 0.2 | 0.14 | balance |
| V | 5.4 | 1.3 | 0.6 | 0.14 | balance |
| VI | 5.4 | 1.3 | 0.4 | 0.14 | balance |
| VII | 5.4 | 1.7 | 0.4 | 0.14 | balance |
| VIII | 5.4 | 1.3 | 0.8 | 0.14 | balance |
| IX | 5.4 | 1.3 | 1.5 | 0.14 | balance |
| X | 5.4 | 1.3 | 2.0 | 0.14 | balance |
| XI | 5.0 | 1.3 | 0.4 | 0.14 | balance |
| XII | 5.2 | 1.3 | 0.4 | 0.14 | balance |

All alloys extruded extremely well with no cracking or surface tearing at a ram speed of 2.5 mm/second at approximately 370° C. (700° F.).

In addition to the alloys listed in Table II, alloys containing Ti additions along with various ancillary element additions were prepared. These alloys are listed in Table IIa.

TABLE IIa

| Nominal Compositions of Experimental Alloys (wt %) | | | | | | | |
|---|---|---|---|---|---|---|---|
| Comp. | Cu | Li | Mg | Zr | Ti | Addition | Al |
| XIII | 5.4 | 1.3 | 0.4 | 0.14 | 0.03 | 0.25 Zn | balance |
| XIV | 5.4 | 1.3 | 0.4 | 0.14 | 0.03 | 0.5 Zn | balance |
| XV | 5.4 | 1.3 | 0.4 | 0.14 | 0.03 | 0.2 Ge | balance |
| XVI | 5.4 | 1.3 | 0.4 | 0.14 | 0.03 | 0.1 In | balance |
| XVII | 5.4 | 1.3 | 0.4 | 0.14 | 0.03 | 0.4 Mn | balance |
| XVIII | 5.4 | 1.3 | 0.4 | 0.14 | 0.03 | 0.2 V | balance |

Several alloys were prepared having lower Cu concentrations than listed above. These alloys are given in Table IIb.

TABLE IIb

| Nominal Compositions of Experimental Alloys (wt %) | | | | | | |
|---|---|---|---|---|---|---|
| Comp. | Cu | Li | Mg | Zr | Ti | Al |
| XIX | 4.5 | 1.3 | 0.4 | 0.14 | 0.03 | balance |
| XX | 4.0 | 1.3 | 0.4 | 0.14 | 0.03 | balance |
| XXI | 3.5 | 1.3 | 0.4 | 0.14 | 0.03 | balance |
| XXII | 3.0 | 1.3 | 0.4 | 0.14 | 0.03 | balance |
| XXIII | 2.5 | 1.3 | 0.4 | 0.14 | 0.03 | balance |

Of the alloys listed in Table IIb, compositions XIX, XX and XXI containing 4.5, 4.0 and 3.5 percent Cu are considered to be within the scope of the present invention, while compositions XXII and XXIII containing 3.0 and 2.5 percent Cu are considered to fall outside of the compositional ranges of the present invention. It has been found that Cu concentrations below about 3.5 percent do not yield the significantly improved properties, such as ultrahigh strength, which are achieved in alloys that contain greater amounts of Cu.

Thus, in accordance with the present invention, the use of Cu in relatively high concentrations, i.e. 3.5–7.0 percent, results in increased tensile and yield strengths over conventional Al-Li alloys. Additionally, the use of greater than about 3.5 Cu is necessary to promote weldability of the alloys, with weldability being extremely good above about 4.5 percent Cu. Concentrations above about 3.5 percent Cu are necessary to provide sufficient Cu to form high volume fractions of $T_1$ ($Al_2CuLi$) strengthening precipitates in the artificially aged tempers. -These precipitates act to increase strength in the alloys of the present invention substantially above the strengths achieved in conventional Al-Li alloys. While Cu concentrations of up to 7 percent are given in the broad compositional range in one embodiment of the present invention, it is possible to exceed this amount, although additional copper above 7 percent may result in decreased corrosion resistance and fracture toughness, while increasing density.

The use of Li in the alloys of the present invention permits a significant decrease in density over conventional Al alloys. Also, Li increases strength and improves elastic modulus. It has been found that the properties of the present alloys vary to a substantial degree depending upon Li content. In the high Cu embodiments (5.0–7.0 percent) of the present invention, substantially improved physical and mechanical properties are achieved with Li concentrations between 0.1 and 2.5 percent, with a peak at about 1.2 percent. Below 0.1 percent, significant reductions in density are not realized, while above 2.5 percent, strength decreases to an undesirable degree. In the low Cu embodiments (3.5–5.0 percent) of the present invention, substantially improved physical and mechanical properties are achieved with Li concentrations between about 0.8 and 1.8 percent, with a peak at about 1.2 percent. Outside of this range, properties such as strength tend to decrease to an undesirable level.

The high Cu to Li weight percent ratio in the alloys of the present invention, which is at least 2.5 and preferably greater than 3.0, is necessary to provide a high volume fraction of $T_1$ strengthening precipitates in the alloys produced. Cu to Li ratios below about 2.5 have been found to yield substantially decreased properties, such as decreased strength.

The use of Mg in the alloys of the present invention increases strength and permits a slight decrease in density over conventional Al alloys. Also, Mg improves resistance to corrosion and enhances natural aging response without prior cold work. It has been found that the strength of the present alloys varies to a substantial degree depending upon Mg content. In the high Cu embodiments (5.0–7.0 percent) of the present invention, substantially improved physical and mechanical properties are achieved with Mg concentrations between 0.05 and 4 percent, with a peak at about 0.4 percent. In the low Cu embodiments (3.5–5.0 percent) of the present invention, substantially improved physical and mechanical properties are achieved with Mg concentrations between about 0.25 and 1.0 percent, with a peak at about 0.4 percent. Outside of the above ranges, significant improvements in properties, such as tensile strength, are not achieved.

Particularly advantageous properties have been observed when Li contents are in the range 1.0–1.4 percent and Mg contents are in the range 0.3–0.5 percent, showing that the type and extent of strengthening precipitates is critically dependent on the amounts of these two elements.

For ease of reference, the temper designations for the various combinations of aging treatment and presence or absence of cold work have been collected in Table III.

TABLE III

| TEMPER DESIGNATIONS | |
|---|---|
| Temper* | Description |
| T3 | solution heat treated<br>cold worked**<br>naturally aged to substantially stable condition |
| T4 | solution heat treated<br>naturally aged to substantially stable condition |
| T6 | solution heat treated<br>artificially aged |
| T8 | solution heat treated |

TABLE III-continued

| Temper* | TEMPER DESIGNATIONS Description |
|---|---|
| | cold worked artificially aged |

*Where additional numbers appear after the standard temper designation, such as T81, this simply indicates a specific type of T8 temper, for example, at a certain aging temperature or for a certain amount of time.

**While a T4 or T6 temper may have cold work to effect geometric integrity, this cold work does not significantly influence the respective aged properties.

A Composition I alloy was cast and extruded using the following techniques. The elements were induction melted under an inert argon atmosphere and cast into 160 mm (6¼ in.) diameter, 23 kg (50 lb) billets. The billets were homogenized in order to affect compositional uniformity of the ingot using a two-stage homogenization treatment. In the first stage, the billet was heated for 16 hours at 454° C. (850° F.) to bring low melting temperature phases into solid solution, and in the second stage it was heated for 8 hours at 504° C. (940° F.). Stage I was carried out below the melting point of any nonequilibrium low-melting temperature phases that form in the as-cast structure, because melting of such phases can produce ingot porosity and/or poor workability. Stage II was carried out at the highest practical temperature without melting, to ensure rapid diffusion to homogenize the composition. The billets were scalped and then extruded at a ram speed of 25 mm/s at approximately 370° C. (700° F.) to form rectangular bars having 10 m by 102 mm (⅜ inch by 4 inch) cross sections.

Figure 1B:
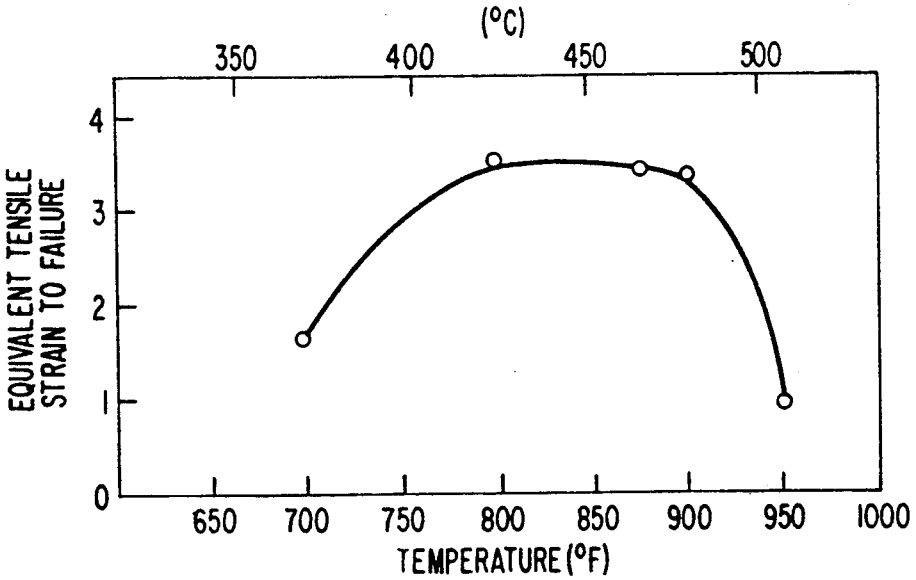

It was determined by hot torsion testing that this alloy is readily workable using conventional aluminum working equipment in practical deformation temperature and strain rate regimes. For example, hot working parameters for more demanding operations such as rolling were determined. Test specimens having a diameter of 6.1 mm (0.24 inch) and a gauge length of 50 mm (2 inches) were machined from extruded stock and rehomogenized. Hot torsion testing was performed at an equivalent tensile strain rate of 0.06 $S^{-1}$ at temperatures ranging from 370° to 510° C. (700° to 950° F.). The equivalent tensile flow stress and equivalent tensile strain-to-failure were evaluated over this temperature range as illustrated in FIG. 1. The strain-to-failure is maximized over a broad range of hot working temperatures from below 427° C. (800° F.) to just over 482° C. (900° F.) allowing sufficient flexibility in choosing temperatures for rolling and forging operations. Liquation occurs at 508° C. °(946° F.) as determined using differential scanning calorimetry (DSC) and cooling curve analysis, and this accounts for the sharp drop in hot ductility at 510° C. (950° F.). The flow stresses over the optimum hot working temperature range are low enough such that processing can be readily performed on presses or mills having capacities consistent with conventional aluminum alloy manufacturing. From a commercial point of view, it is interesting to note that similar studies using as-cast and homogenized material of Composition I show the same trends.

The rectangular bar extrusions that were not used in the hot torsion testing were subsequently solution heat treated at 503° C. (938° F.) for 1 hour and water quenched. Some segments of each extrusion were stretch straightened approximately 3 percent within 3 hours of quenching. This stretch straightening process straightens the extrusion and also introduces cold work. Some of the segments, both with and without cold work, were naturally aged at approximately 20° C (68° F.). Other segments were artificially aged, at 160° C. (320° F.) if cold worked, or at 180° C. (356° F.) if not cold worked.

The superior properties of Composition I compared to conventional alloys 2219 and 2024 are shown in Table IV. In particular, it should be noted that the naturally aged (T3 and T4) conditions for Composition I are being compared to the optimum high strength T8 tempers for the conventional alloys.

TABLE IV

| Alloy | Temper | TENSILE PROPERTIES YS (ksi) | UTS (ksi) | El. (%) |
|---|---|---|---|---|
| Comp. I | T4 | 61.9 | 85.0 | 16.5 |
| | T3 | 60.3 | 76.6 | 15.0 |
| 2219 | T81 minima | 44.0 | 61.0 | 6.0 |
| | T81 typicals | 51.0 | 66.0 | 10.0 |
| 2024 | T42 minima | 38.0 | 57.0 | 12.0 |
| | T81 minima | 58.0 | 66.0 | 5.0 |

Table V shows naturally aged tensile properties for various alloys of the present invention.

TABLE V

NATURALLY AGED TENSILE PROPERTIES

| Alloy Comp. | Temper | Aging Time (h) | YS (ksi) | UTS (ksi) | El. (%) |
|---|---|---|---|---|---|
| II | T3 | 1300 | 51.1 | 67.0 | 14.6 |
| | T4 | 1400 | 50.9 | 75.0 | 17.8 |
| III | T3 | 1300 | 58.2 | 75.9 | 17.4 |
| | T4 | 1400 | 58.0 | 80.9 | 18.1 |
| IV | T3 | 1300 | 51.0 | 69.0 | 17.6 |
| | T4 | 1400 | 54.5 | 78.0 | 20.1 |
| V | T3 | 1300 | 58.2 | 75.4 | 16.5 |
| | T4 | 1400 | 58.0 | 82.5 | 19.2 |
| VI | T3 | 1300 | 58.2 | 75.3 | 16.9 |
| | T4 | 1400 | 59.9 | 83.4 | 18.2 |
| VII | T3 | 1300 | 57.3 | 71.6 | 14.4 |
| | T4 | 1400 | 60.6 | 81.2 | 14.1 |
| VIII | T3 | 1300 | 58.4 | 75.0 | 16.7 |
| | T4 | 1400 | 60.7 | 82.8 | 16.5 |
| IX | T3 | 1100 | 55.8 | 68.2 | 14.3 |
| | T4 | 1100 | 53.5 | 71.1 | 15.1 |
| X | T3 | 1100 | 53.7 | 64.4 | 12.1 |
| | T4 | 1100 | 49.4 | 67.2 | 15.1 |
| XI | T3 | 1000 | 58.8 | 75.0 | 15.5 |
| | T4 | 1000 | 64.5 | 84.6 | 14.1 |
| | T4 | 1400 | 57.9 | 81.8 | 16.9 |
| XII | T3 | 1000 | 60.2 | 76.6 | 17.2 |
| | T4 | 1000 | 59.0 | 81.1 | 14.8 |
| XIII | T3 | 2300 | 58.3 | 76.5 | 15.1 |
| | T4 | 1000 | 56.3 | 80.3 | 15.5 |
| XIV | T3 | 2300 | 58.4 | 77.2 | 18.2 |
| | T4 | 1000 | 62.5 | 85.3 | 16.4 |
| XV | T4 | 1000 | 52.0 | 75.2 | 18.7 |
| XVI | T4 | 1000 | 53.9 | 77.7 | 18.1 |
| XVII | T4 | 1000 | 54.8 | 79.3 | 18.0 |
| XVIII | T4 | 1000 | 58.0 | 78.1 | 14.1 |
| XIX | T3 | 1000 | 54.6 | 72.2 | 16.1 |
| | T4 | 1000 | 60.4 | 83.8 | 17.0 |
| XX | T3 | 1000 | 49.9 | 64.5 | 13.8 |
| | T4 | 1000 | 58.9 | 80.8 | 18.6 |
| XXI | T3 | 1000 | 51.7 | 66.7 | 18.1 |
| | T4 | 1000 | 45.6 | 67.5 | 15.4 |
| XXII | T3 | 1000 | 49.3 | 63.1 | 14.5 |
| | T4 | 1000 | 49.6 | 71.7 | 18.4 |
| XXIII | T3 | 1000 | 43.5 | 57.1 | 13.9 |
| | T4 | 1000 | 41.1 | 62.3 | 15.8 |

Composition I exhibits a phenomenal natural aging response. The tensile properties of Composition I in the naturally aged condition without prior cold work, T4 temper, are even superior to those of alloy 2219 in the artificially aged condition with prior cold work, i.e. in the fully heat treated condition or T81 temper. Composition I in the T4 temper has 61.9 ksi YS, 85.0 ksi UTS and 16.5 percent elongation. By contrast, the handbook property minima for extrusions of 2219-T81, the current standard space alloy, are 44.0 ksi YS, 61.0 ksi UTS and 6 percent elongation (See Table IV). The T81 temper is the highest strength standard temper for 2219 extrusions of similar geometry to the Composition I alloy. Composition I in the naturally aged tempers also has superior properties to alloy 2024 in the high strength T81 temper, one of the leading aircraft alloys, which has 58 ksi YS, 66 ksi UTS and 5 percent elongation handbook minima. Alloy 2024 also exhibits a natural aging response, i.e. T42, but it is far less than that of Composition I (see Table IV).

To determine the appropriate temperatures for artificial aging, aging studies were performed and indicated that near-peak strengths could be obtained in technologically practical periods of time as follows: 160° C. for stretched material, or 180° C. for unstretched material. The lower temperature was selected for the stretched material because the dislocations introduced by the cold work accelerate the aging kinetics.

Figure 2:
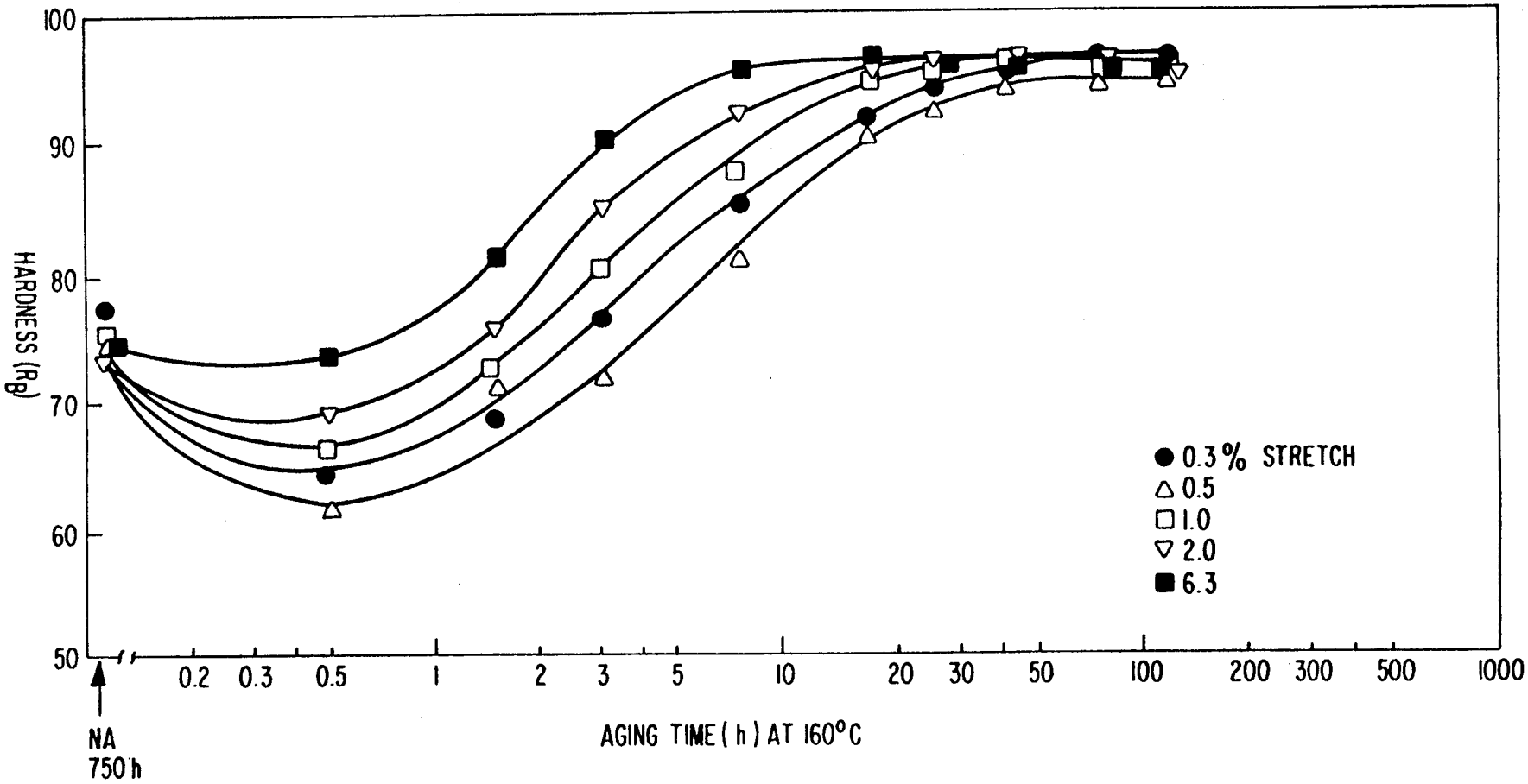
FIG. 2 shows aging curves of Rockwell B Hardness for Composition I with various amounts of stretch.
Figure 3:
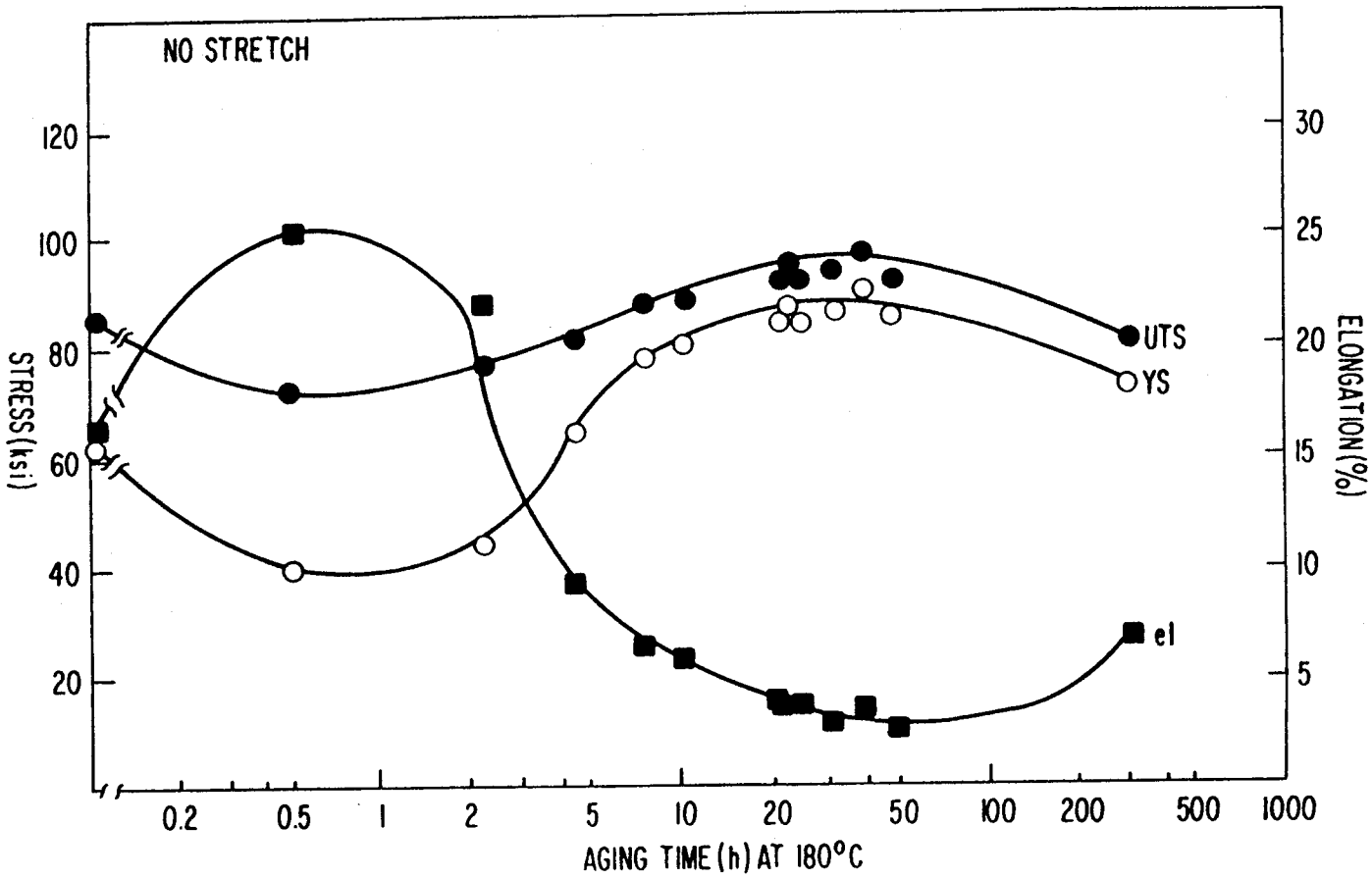
FIG. 3 shows an aging curve of strength and ductility vs. time for Composition I in a T6 temper.
Figure 4:
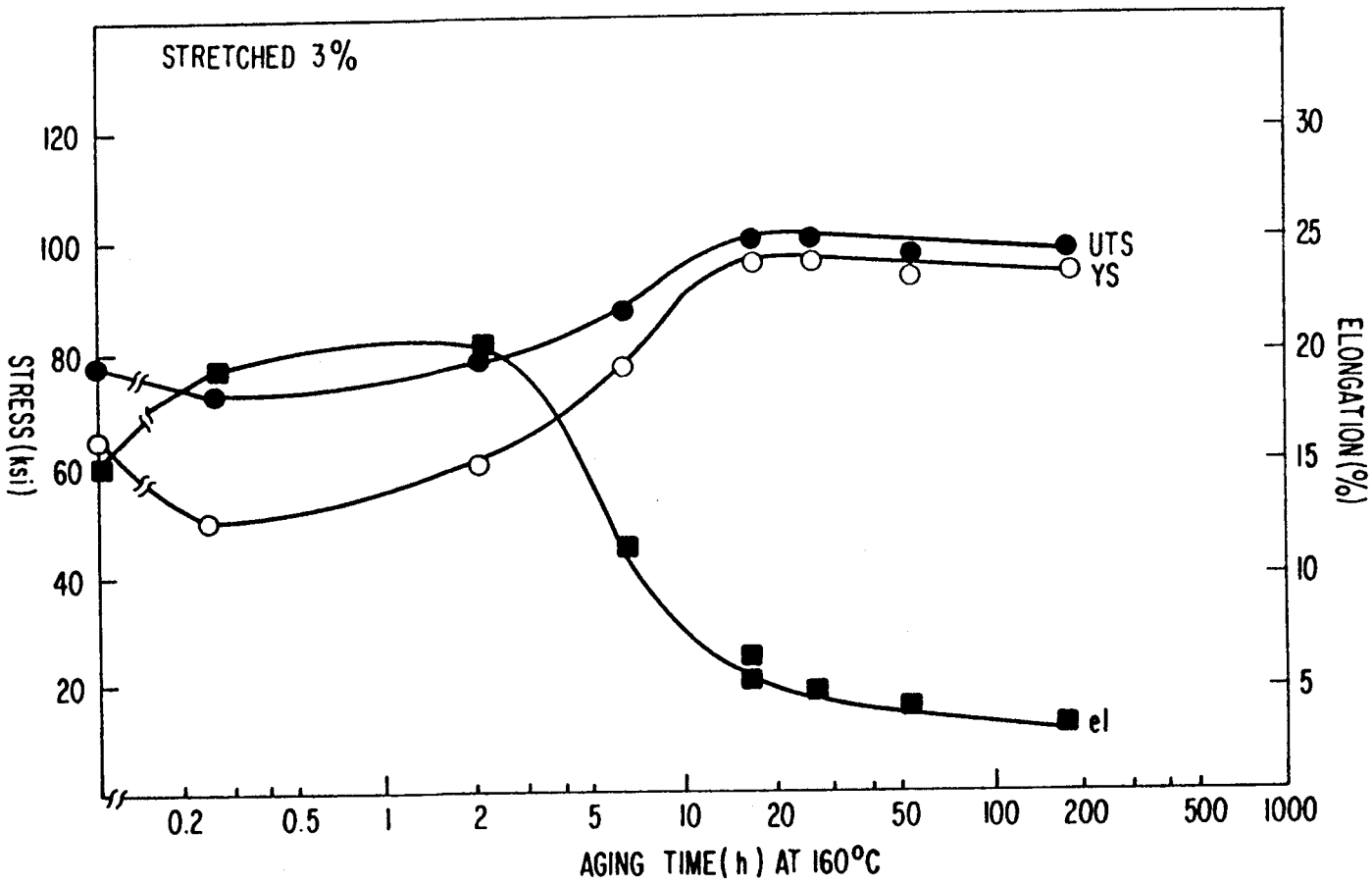
FIG. 4 shows an aging curve of strength and ductility vs. Time for Composition I in a T8 temper.

In the artificially-aged condition, Composition I attains ultrahigh strength. Of particular significance is the fact that peak tensile strengths (UTS) close to 100 ksi and elongations of a percent may be obtained in both the T8 and T6 tempers. This indicates that cold work is not necessary to achieve ultrahigh strengths in the alloys of the present invention, as it typically is in conventional 2XXX alloys. This is illustrated graphically in FIG. 2, which shows that Rockwell B hardness (a measure of alloy hardness that corresponds approximately one-to-one with UTS for these alloys) reaches the same ultimate value irrespective of the amount of cold work (stretch) after sufficient aging time. This should provide considerable freedom in the manufacturing processes associated with aircraft and aerospace hardware. Additionally, elongations of up to 25 percent were achieved in grossly underaged, i.e. reverted, tempers (see Table VI for properties of compositions I, VI, XI, and XII, and Table VI a for additional properties of alloys prepared in accordance with the present invention). High ductility tempers such as this can be extremely useful in fabricating aerospace structural components because of the extensive cold-forming limits. The curves in FIGS. 3 and 4 show how the strength/ductility combination varies with artificial aging times for non-cold worked and cold worked alloys.

TABLE VI

ARTIFICIALLY AGED TENSILE PROPERTIES

| Alloy Comp. | Temper | Temper Description | Aging Time (h) | Aging Temp. (°C.) | YS (ksi) | UTS (ksi) | El. (%) |
|---|---|---|---|---|---|---|---|
| I | T8 | near peak | 24 | 160 | 95.7 | 99.4 | 4.5 |
| | T8 | near peak | 24 | 160 | 94.5 | 98.0 | 5.0 |
| | T8 | near peak | 15.5 | 160 | 94.8 | 99.0 | 6.5 |
| | T8 | under aged | 2 | 160 | 58.6 | 77.7 | 20.0 |
| | T6 | reversion | 0.5 | 180 | 40.1 | 72.6 | 25.0 |
| | T6 | near peak | 22 | 180 | 87.4 | 94.1 | 4.0 |
| | T6 | over aged | 38.5 | 180 | 89.5 | 96.6 | 4.0 |
| VI | T8 | under aged | 6 | 160 | 80.5 | 89.1 | 11.8 |
| | T8 | near peak | 20 | 160 | 93.0 | 96.8 | 8.3 |
| | T8 | near peak | 24 | 160 | 92.0 | 95.5 | 6.4 |
| | T6 | near peak | 22 | 180 | 82.7 | 90.1 | 7.0 |
| | T6 | under aged | 16 | 180 | 78.3 | 87.0 | 7.8 |
| XI | T8 | reversion | 0.25 | 160 | 53.8 | 74.0 | 16.3 |
| | T8 | under aged | 6 | 160 | 81.2 | 88.6 | 12.9 |

TABLE VI-continued

ARTIFICIALLY AGED TENSILE PROPERTIES

| Alloy Comp. | Temper | Temper Description | Aging Time (h) | Aging Temp. (°C.) | YS (ksi) | UTS (ksi) | El. (%) |
|---|---|---|---|---|---|---|---|
| | T8 | under aged | 16 | 160 | 93.8 | 97.1 | 7.5 |
| | T8 | under age | 20 | 160 | 92.4 | 96.2 | 8.9 |
| | T8 | near peak | 24 | 160 | 95.1 | 98.4 | 8.4 |
| | T8 | near peak | 24 | 160 | 96.7 | 100.3 | 6.7 |
| | T6 | reversion | 0.25 | 180 | 39.1 | 68.9 | 23.9 |
| | T6 | under aged | 6 | 180 | 83.4 | 91.3 | 7.9 |
| | T6 | under aged | 16 | 180 | 81.6 | 90.7 | 7.3 |
| | T6 | near peak | 22 | 180 | 84.6 | 92.4 | 5.5 |
| | T6 | near peak | 22.5 | 180 | 88.8 | 94.2 | 7.4 |
| XII | T8 | under aged | 16 | 180 | 91.8 | 96.3 | 7.2 |
| | T8 | under aged | 20 | 160 | 92.3 | 96.3 | 7.4 |
| | *T8 | | 20 | 160 | 102.4 | 104.5 | 6.1 |
| | T6 | near peak | 22 | 180 | 85.3 | 92.3 | 5.5 |
| | *T6 | | 16 | 180 | 84.4 | 92.9 | 7.1 |

*measurements made on 0.375 inch extruded rod

TABLE VI a

ARTIFICIALLY AGED TENSILE PROPERTIES

| Alloy Comp. | Temper | Temper Description | Aging Time (h) | Aging Temp. (°C.) | YS (ksi) | UTS (ksi) | El. (%) |
|---|---|---|---|---|---|---|---|
| II | T8 | under aged | 6 | 160 | 74.1 | 84.0 | 11.2 |
| | T8 | under aged | 20 | 160 | 89.4 | 93.8 | 7.3 |
| | T8 | near peak | 24 | 160 | 90.1 | 94.3 | 5.8 |
| | T6 | under aged | 16 | 180 | 63.4 | 77.7 | 6.4 |
| | T6 | near peak | 22.5 | 180 | 68.2 | 81.0 | 4.9 |
| III | T8 | under aged | 6 | 160 | 76.1 | 85.1 | 10.9 |
| | T8 | under aged | 20 | 160 | 91.7 | 95.3 | 6.9 |
| | T8 | near peak | 24 | 160 | 92.2 | 95.8 | 7.4 |
| | T6 | under aged | 16 | 180 | 78.8 | 88.0 | 8.1 |
| | T6 | near peak | 22.5 | 180 | 82.1 | 89.4 | 4.3 |
| IV | T8 | under aged | 6 | 160 | 71.5 | 83.3 | 14.6 |
| | T8 | under aged | 20 | 160 | 87.0 | 92.3 | 8.2 |
| | T8 | near peak | 24 | 160 | 89.6 | 94.9 | 7.4 |
| | T6 | under aged | 16 | 180 | 58.1 | 77.5 | 11.7 |
| | T6 | near peak | 22.5 | 180 | 65.7 | 80.8 | 8.2 |
| V | T8 | under aged | 6 | 160 | 78.0 | 87.0 | 11.7 |
| | T8 | under aged | 20 | 160 | 87.7 | 92.6 | 7.8 |
| | T8 | near peak | 24 | 160 | 89.1 | 94.1 | 8.3 |
| | T6 | under aged | 16 | 180 | 75.4 | 85.6 | 9.1 |
| VII | T8 | under aged | 6 | 160 | 73.2 | 81.3 | 8.9 |
| | T8 | under aged | 20 | 160 | 85.3 | 89.1 | 5.9 |
| | T8 | near peak | 24 | 160 | 85.7 | 89.7 | 6.5 |
| | T6 | under aged | 16 | 180 | 70.5 | 81.5 | 9.5 |
| | T6 | near peak | 22.5 | 180 | 80.4 | 86.3 | 6.4 |
| VIII | T8 | under aged | 6 | 160 | 75.7 | 83.9 | 11.0 |
| | T8 | under aged | 20 | 160 | 90.1 | 93.5 | 7.2 |
| | T8 | near peak | 24 | 160 | 89.8 | 93.5 | 6.4 |
| | T6 | under aged | 16 | 180 | 76.0 | 86.0 | 8.0 |
| | T6 | near peak | 22.5 | 180 | 81.0 | 87.6 | 7.0 |
| IX | T8 | under aged | 24 | 160 | 662.2 | 72.1 | 11.0 |
| | T8 | under aged | 24 | 180 | 75.4 | 76.6 | 4.5 |
| X | T8 | under aged | 24 | 160 | 55.2 | 68.2 | 12.7 |
| | T8 | under aged | 24 | 180 | 70.0 | 72.8 | 7.6 |
| XIII | T8 | under aged | 20 | 160 | 93.4 | 97.5 | 7.1 |
| | T8 | near peak | 24 | 160 | 98.5 | 101.9 | 6.3 |
| | T6 | near peak | 22 | 180 | 89.2 | 94.8 | 3.9 |
| XIV | T8 | under aged | 20 | 160 | 99.4 | 102.6 | 7.6 |
| | T8 | under aged | 22 | 160 | 93.3 | 97.1 | 8.4 |
| | T8 | near peak | 24 | 160 | 95.9 | 99.1 | 6.0 |
| | T6 | near peak | 21 | 180 | 89.3 | 94.9 | 4.9 |
| XV | T8 | under aged | 20 | 160 | 89.5 | 94.7 | 7.8 |
| | T8 | near peak | 24 | 160 | 91.8 | 95.4 | 7.7 |
| | T6 | near peak | 22 | 180 | 80.4 | 89.9 | 5.9 |
| XVI | T8 | under aged | 20 | 160 | 92.7 | 97.0 | 8.1 |
| | T8 | near peak | 24 | 160 | 92.3 | 96.1 | 7.7 |
| | T6 | near peak | 22 | 180 | 80.8 | 89.0 | 6.2 |
| XVII | T8 | under aged | 20 | 160 | 91.4 | 94.6 | 8.2 |
| | T8 | near peak | 24 | 160 | 94.1 | 97.5 | 6.9 |
| XVIII | T8 | under aged | 20 | 160 | 96.0 | 99.0 | 4.6 |
| | T8 | near peck | 24 | 160 | 93.0 | 95.4 | 3.6 |
| XIX | T8 | reversion | .25 | 160 | 48.9 | 72.0 | 20.5 |
| | T8 | under aged | 6 | 160 | 73.8 | 82.3 | 11.5 |

TABLE VI a-continued

ARTIFICIALLY AGED TENSILE PROPERTIES

| Alloy Comp. | Temper | Temper Description | Aging Time (h) | Aging Temp. (°C.) | YS (ksi) | UTS (ksi) | El. (%) |
|---|---|---|---|---|---|---|---|
| | T8 | under aged | 16 | 160 | 95.7 | 98.7 | 9.0 |
| | T8 | underaged | 16 | 180 | 87.0 | 91.8 | 8.0 |
| | T8 | under aged | 20 | 160 | 89.3 | 93.7 | 9.6 |
| | T8 | near peak | 24 | 160 | 92.7 | 96.1 | 8.4 |
| | T6 | reversion | .25 | 180 | 36.5 | 65.4 | 25.5 |
| | T6 | under aged | 6 | 180 | 66.3 | 80.1 | 12.4 |
| | T6 | near peak | 22 | 180 | 82.2 | 88.4 | 7.3 |
| XX | T8 | under aged | 16 | 180 | 80.1 | 85.3 | 10.9 |
| | T8 | under aged | 24 | 160 | 88.6 | 92.0 | 11.5 |
| | T6 | near peak | 22 | 180 | 66.8 | 75.7 | 12.0 |
| XXI | T8 | under aged | 16 | 180 | 78.3 | 83.7 | 10.2 |
| | T8 | under aged | 24 | 160 | 77.8 | 82.8 | 12.4 |
| | T6 | near peak | 22 | 180 | 65.3 | 75.3 | 10.9 |
| XXII | T8 | under aged | 16 | 180 | 68.8 | 74.1 | 10.1 |
| | T8 | under aged | 24 | 160 | 67.3 | 73.2 | 11.8 |
| | T6 | near peak | 22 | 180 | 54.8 | 67.6 | 11.4 |
| XXIII | T8 | under aged | 16 | 180 | 59.0 | 66.0 | 8.8 |
| | T8 | under aged | 24 | 160 | 57.7 | 63.8 | 10.2 |

It is noted that while certain processing steps are disclosed for the production of the alloy products of the present invention, these steps may be modified in order to achieve various desired results. Thus, the steps including casting, homogenization, working, heat treating, aging, etc. may be altered, or additional steps may be added, to affect, for example, the physical and mechanical properties of the final products formed. Characteristics such as the type, size and distribution of strengthening precipitates may thus be controlled to some degree depending upon processing techniques. Also, grain size and crystallinity of the final product may be controlled to some extent. Therefore, in addition to the processing techniques taught in the present disclosure, other conventional methods may be used in the production of the alloys of the present invention.

While the formation of ingots or billets of the present alloys by casting techniques is preferred, the alloys may also be provided in billet form consolidated from fine particulate. The powder or particulate material can be produced by such processes as atomization, mechanical alloying and melt spinning.

Figure 5A:
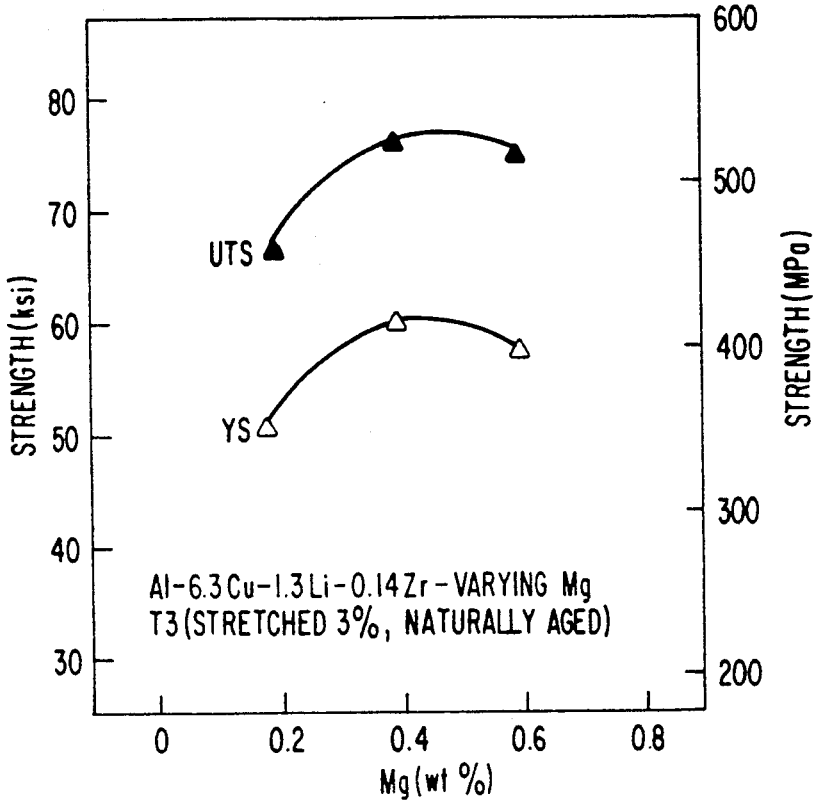
FIG. 5A shows how tensile properties vary E1 with the Mg level in Al - 6.3 Cu - 1.3 Li - 0.14 Zr containing alloys in the T3 temper.
Figure 6A:
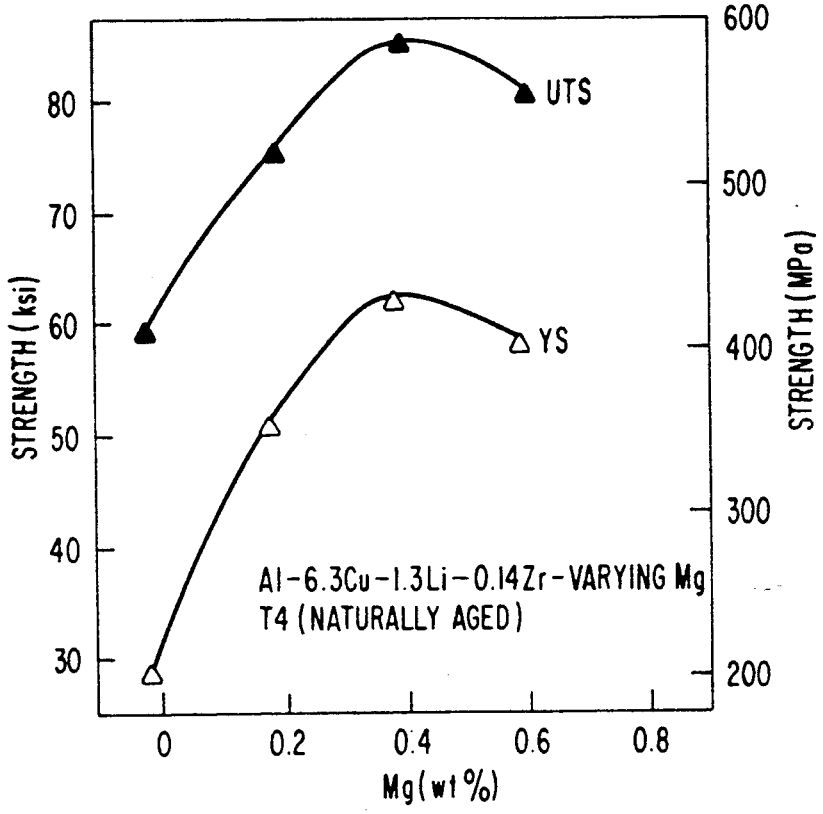
FIG. 6A shows how tensile properties vary E2 with the Mg level in Al - 6.3 Cu - 1.3 Li - 0.14 Zr containing alloys in the T4 temper.
Figure 7A:
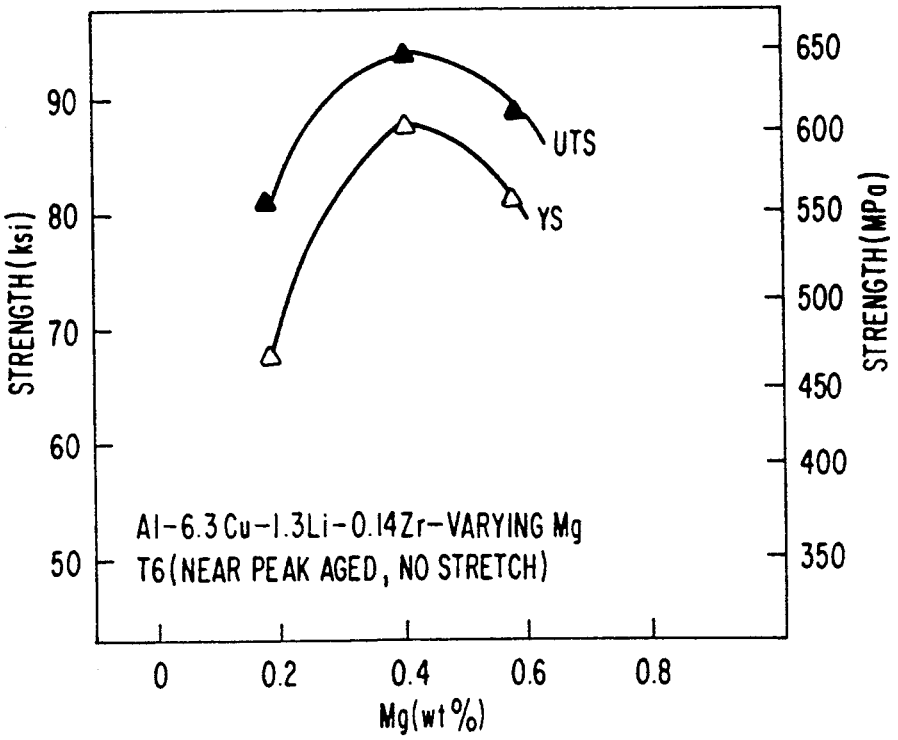
FIG. 7A shows how tensile properties vary E3 with the Mg level in Al - 6.3 Cu - 1.3 Li - 0.14 Zr containing alloys in the T6 temper.
Figure 8A:
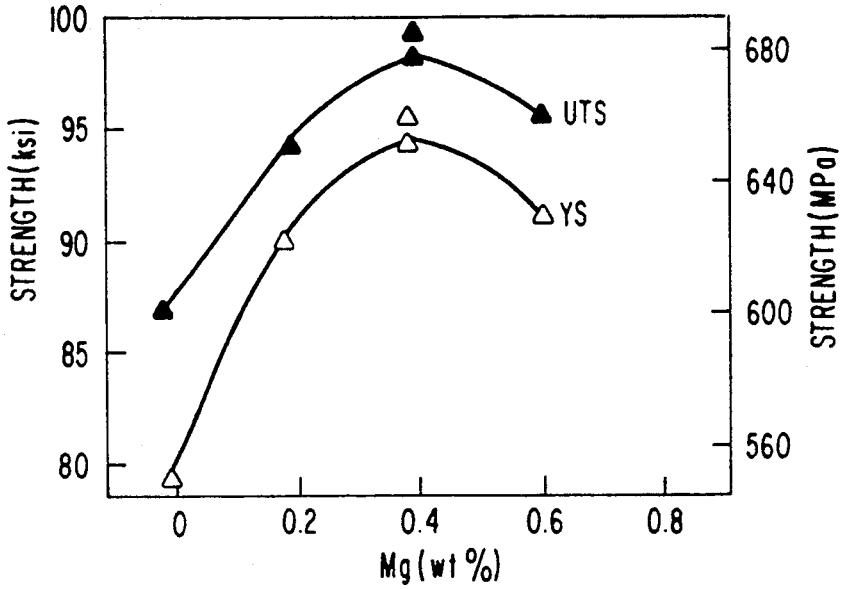
FIG. 8A shows how tensile properties vary E4 with the Mg level in Al - 6.3 Cu - 1.3 Li - 0.14 Zr containing alloys in the T8 temper.

An investigation was made on the effect of Mg content on the tensile properties of alloys prepared according to the present invention. FIG. 5A shows that alloys of the composition Al - 6.3 Cu - 1.3 Li - 0.14 Zr, with various amounts of Mg, have a peak in naturally aged strength at 0.4 weight percent Mg in the T3 temper and FIG. 6A shows a similar peak in the T4 temper. In addition, the highest strength in the artificially aged T6 and T8 tempers is also attained at 0.4 weight percent Mg, as shown in FIGS. 7A and 8A. It is known in conventional 2XXX alloys that increasing Mg content produces increasing strength, e.g. 2024, 2124, and 2618 alloys generally contain 1.5 weight percent Mg. It is thus surprising that a peak should be obtained in the present alloys at such a low Mg level and that increased Mg content above about 0.4 weight percent does not increase strength.

Figure 9A:
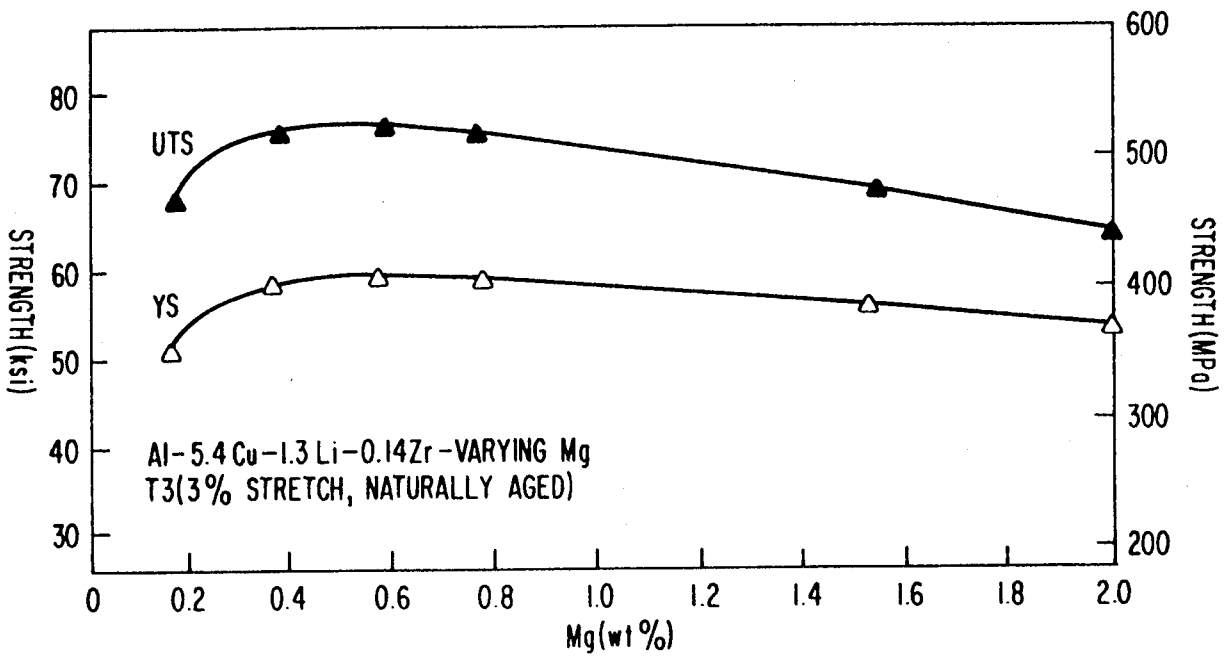
FIG. 9A shows how tensile properties vary E5 with the Mg level in Al - 5.4 Cu - 1.3 Li - 0.14 Zr containing alloys in the T3 temper.
Figure 10A:
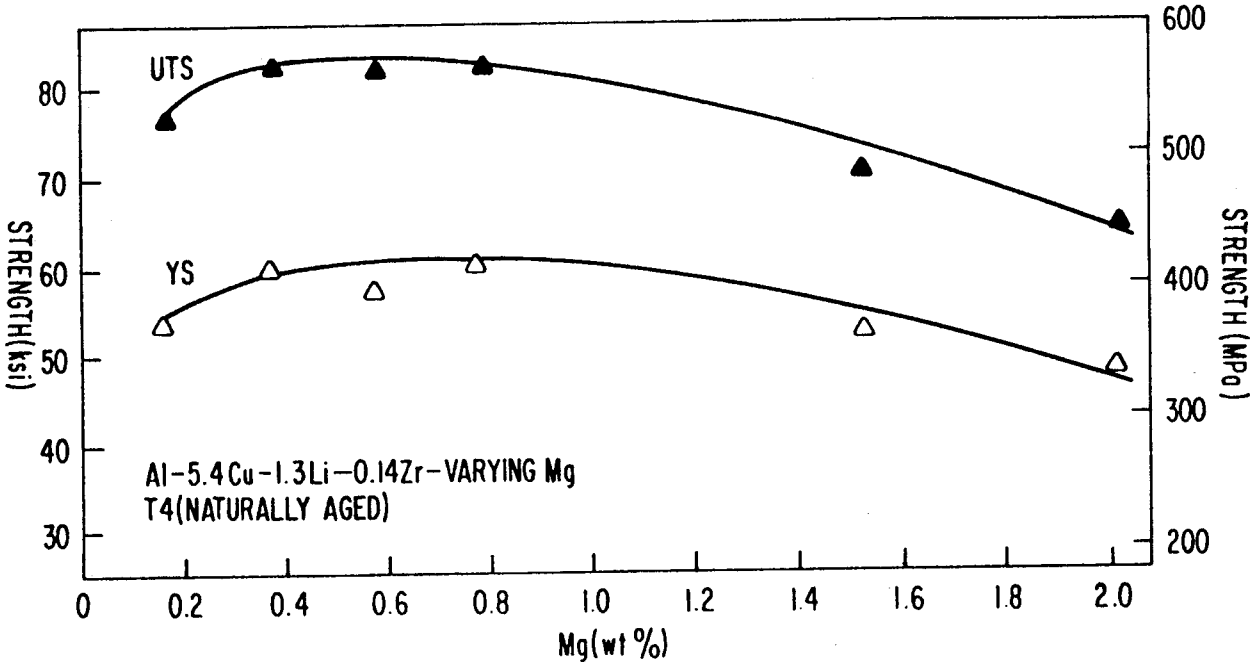
FIG. 10A shows how tensile properties vary E6 with the Mg level in Al - 5.4 Cu - 1.3 Li - 0.14 Zr containing alloys in the T4 temper.
Figure 11A:
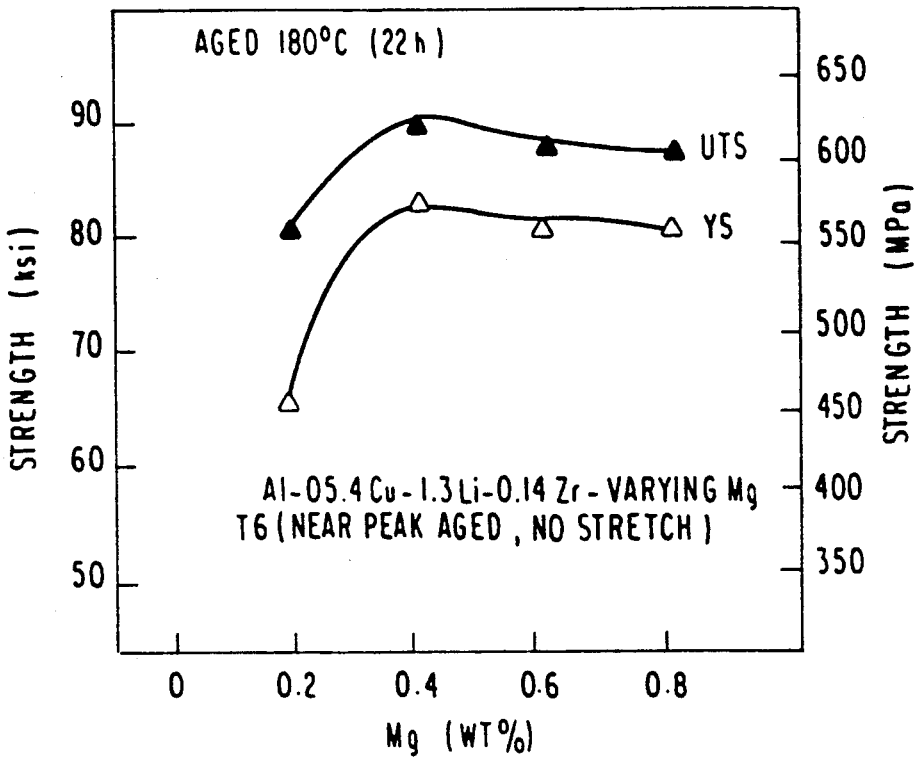
FIG. 11A shows how tensile properties vary E7 with the Mg level in Al - 5.4 Cu - 1.3 Li - 0.14 Zr containing alloys in the T6 temper (near peak aged).
Figure 12A:
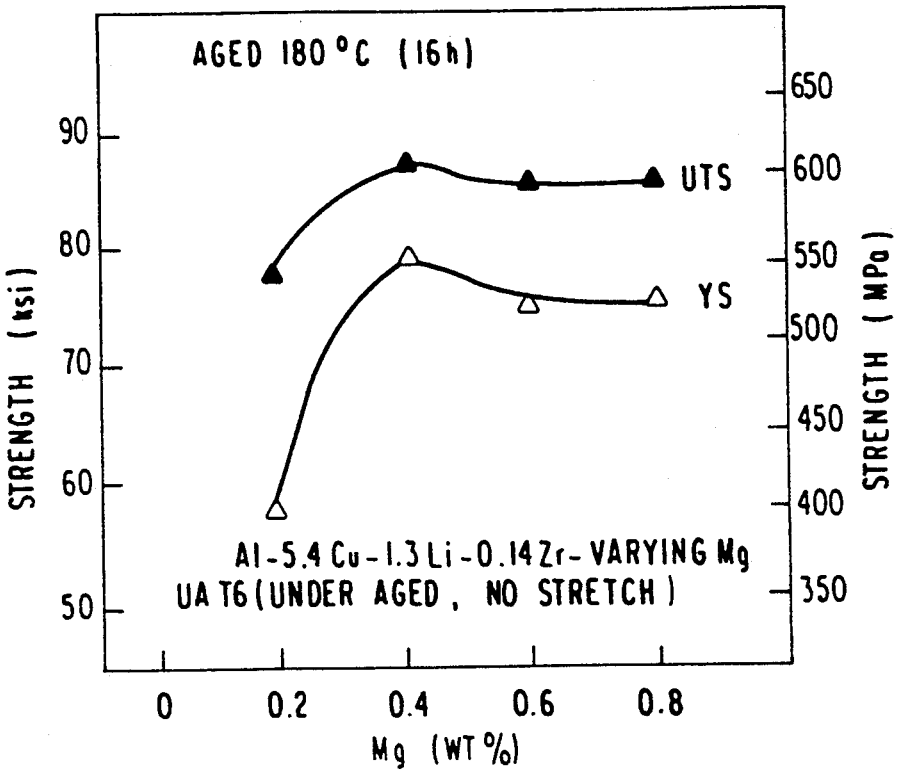
FIG. 12A shows how tensile properties vary E8 with the Mg level in Al - 5.4 Cu - 1.3 Li - 0.14 Zr containing alloys in the T6 temper (under aged).
Figure 13A:
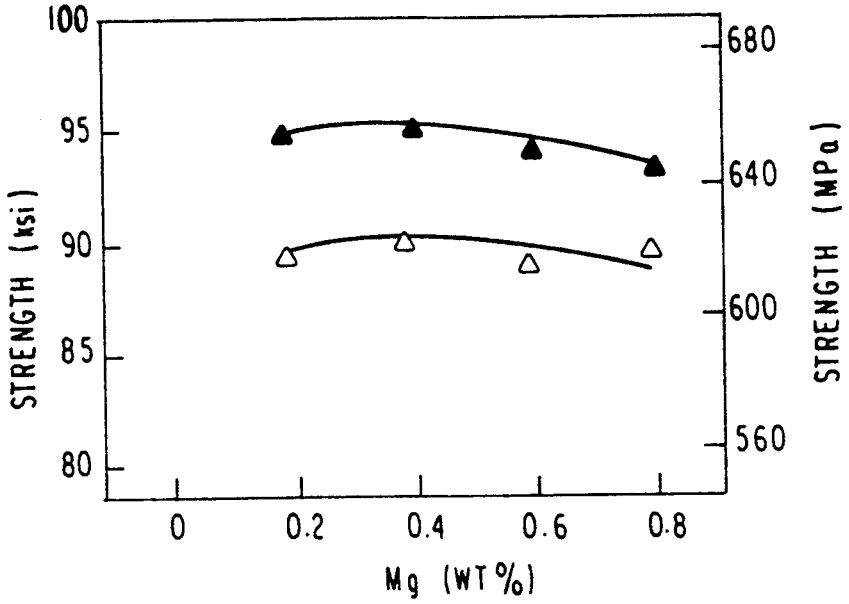
FIG. 13A shows how tensile properties vary E9 with the Mg level in Al - 5.4 Cu - 1.3 Li - 0.14 Zr containing alloys in the T8 temper.

The situation is similar in Al - 5.4 Cu - 1.3 Li - 0.14 Zr alloys with varying Mg content. For example, naturally aged strength is highest around 0.4 weight percent Mg with a gradual decrease in strength at 1.5 and 2.0 weight percent Mg in both the T3 and T4 tempers, as shown in FIGS. 9A and 10A. In the T6 temper (both near peak and under aged conditions) the strength is again highest around 0.4 weight percent Mg. See FIG. 11A (near peak aged) and FIG. 12A (under aged). In the T8 temper (FIG. 13A), strength is also highest at 0.4 weight percent Mg, although the peak is less dramatic than in the T3, T4 and T6 tempers.

The tensile properties of the alloys of the present invention are highly dependent upon Li content. Peak strengths are attained with Li concentrations of about 1.1 to 1.3 percent, with significant decreases above about 1.4 percent and below about 1.0 percent. For example, a comparison between tensile properties of alloy Composition VI of the present invention (Al - 5.4 Cu - 1.3 Li - 0.4 Mg - 0.14 Zr) and alloy Composition VII (Al - 5.4 Cu - 1.7 Li - 0.4 Mg - 0.14 Zr) reveals a decrease of over 8 ksi in both yield strength and ultimate tensile strength (see Tables VI and VIa).

In general, it has been found that the most advantageous properties, such as strength and elongation, have been achieved in alloys having a combination of relatively narrow Mg and Li ranges. For a particular temper, alloys of the present invention in the range 4.5–7.0 Cu, 1.0–1.4 Li, 0.3–0.5 Mg, 0.05–0.5 grain refiner, and the balance Al, possess extremely useful longitudinal strengths and elongations. For example, in the T3 temper, alloys within the above mentioned compositional ranges display a YS range of from about 55 to about 65 ksi, a UTS range of from about 70 to about 80 ksi, and an elongation range of from about 12 to about 20 percent. In the T4 temper, alloys within this compositional range display a YS range of from about 56 to about 68 ksi, a UTS range of from about 80 to about 90 ksi, and an elongation range of from about 12 to about 20 percent. Additionally, in the T6 temper, these alloys display a YS range of from about 80 to about 100 ksi, a UTS range of from about 85 to about 105 ksi, and an elongation range of from about 2 to about 10 percent. Further, in the T8 temper, alloys within the above-noted compositional range display a YS range of from about 87 to about 100 ksi, a UTS range of from about 88 to about 105 ksi, and an elongation range of from about 2 to about 11 percent.

Figure 14:
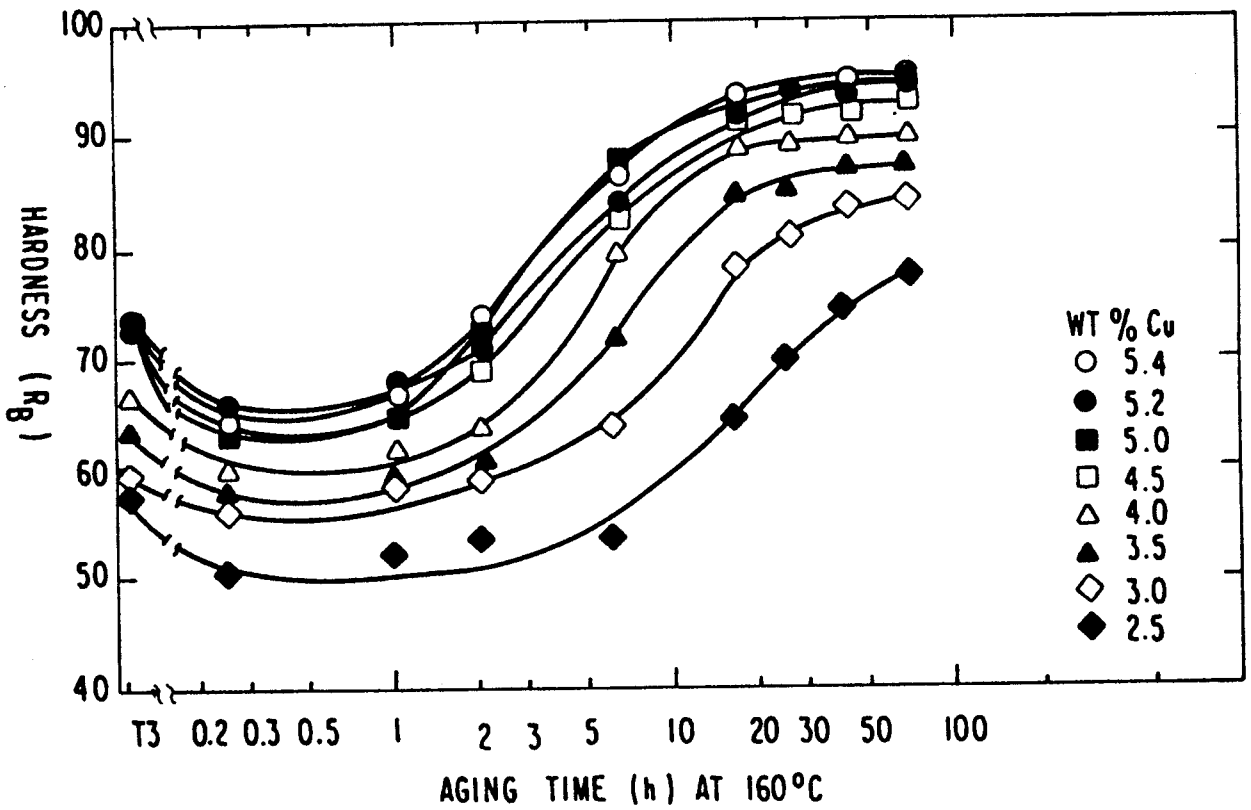
FIG. 14 shows aging curves of hardness vs. time for Al - 1.3 Li - 0.4 Mg - 0.14 Zr - 0.05 Ti containing alloys, with varying amounts of Cu, in the T8 condition.
Figure 15:
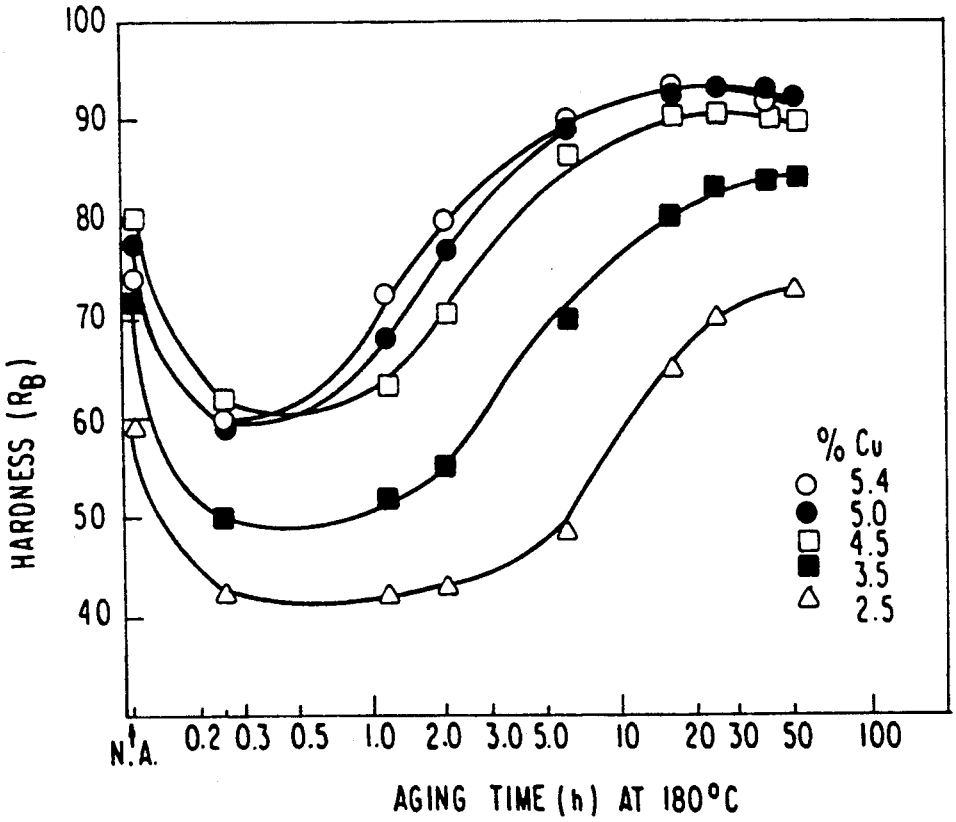
FIG. 15 shows aging curves of hardness vs. time for Al - 1.3 Li - 0.4 Mg - 0.14 Zr - 0.05 Ti containing alloys, with varying amounts of Cu, in the T6 condition.

An investigation was made on the effect of Cu content on the hardness and tensile properties of alloys prepared according to the present invention. Alloys comprising Al - 1.3 Li - 0.4 Mg - 0.14 Zr and 0.05 Ti, with varying concentrations of Cu ranging from 2.5 to 5.4 percent, were cast, homogenized, scalped, extruded, solution heat-treated, quenched, stretched by either 0 percent or 3 percent, and heat treated in a manner similar to that discussed for Composition I above. FIG. 14 shows hardness vs. aging time curves for alloys with varying Cu content which have been subjected to 3 percent stretch and aged at 160° C. As can be seen from FIG. 14, hardness increases with increasing Cu content for alloys in the cold worked, artificially aged condition. FIG. 15 shows hardness vs. aging time curves for alloys with varying Cu content which have been subjected to zero stretch and aged at 180° C. As can be seen from FIG. 15, hardness increases with increasing Cu content for alloys in the non-cold worked, artificially aged condition.

Figure 16A:
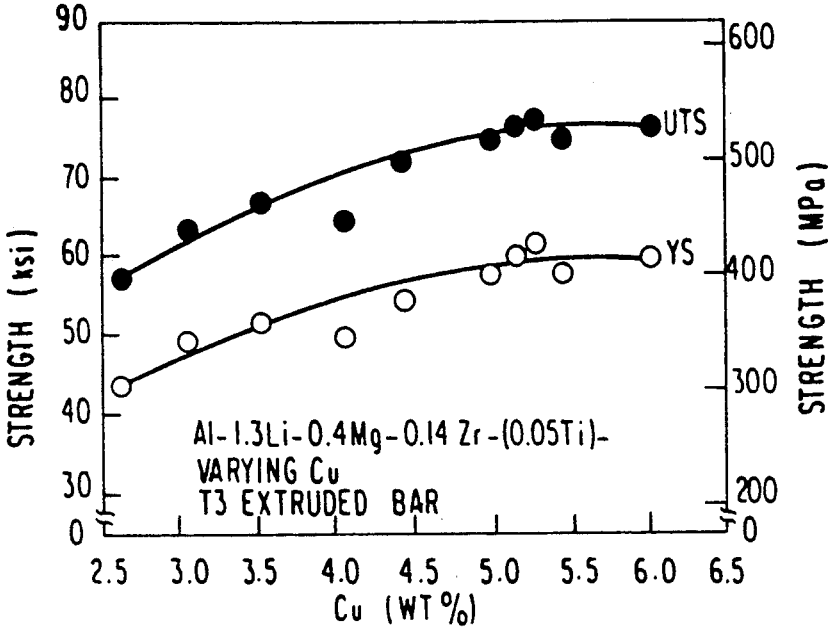
FIG. 16A shows how tensile properties vary E10 with the Cu level in Al - 1.3 Li - 0.4 Mg - 0.14 Zr - 0.05 Ti containing alloys in the T3 temper.
Figure 17A:
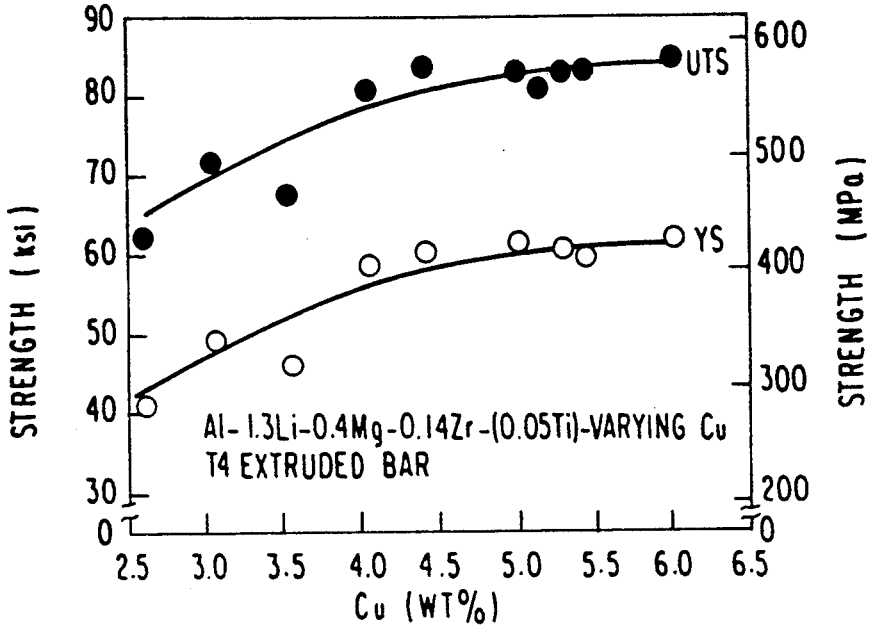
FIG. 17A shows how tensile properties vary E11 with the Cu level in Al - 1.3 Li - 0.4 Mg - 0.14 Zr - 0.05 Ti containing alloys in the T4 temper.
Figure 18A:
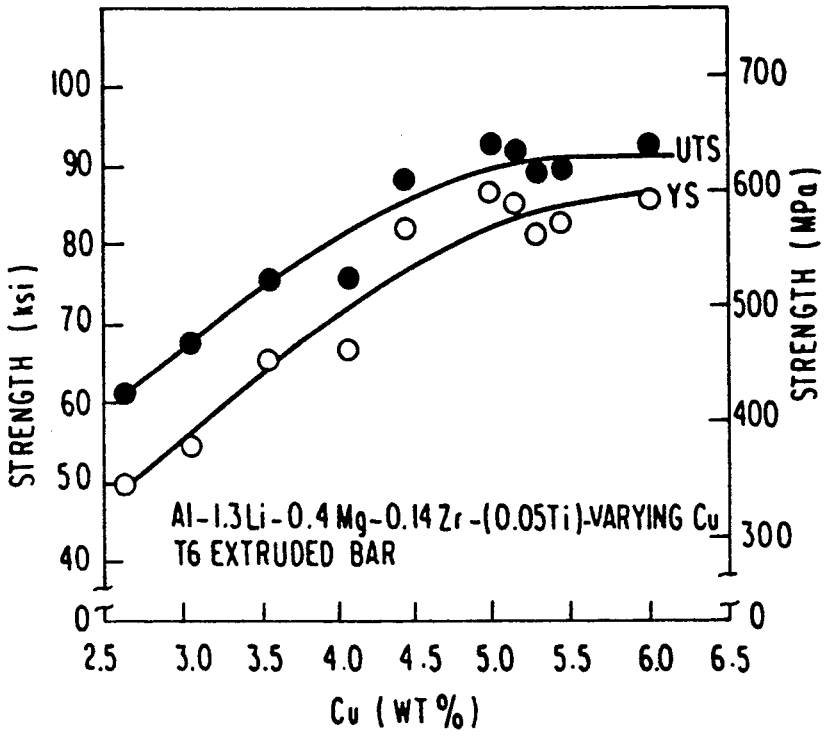
FIG. 18A shows how tensile properties vary E12 with the Cu level in Al - 1.3 Li - 0.4 Mg - 0.14 Zr - 0.05 Ti containing alloys in the T6 temper.
Figure 19A:
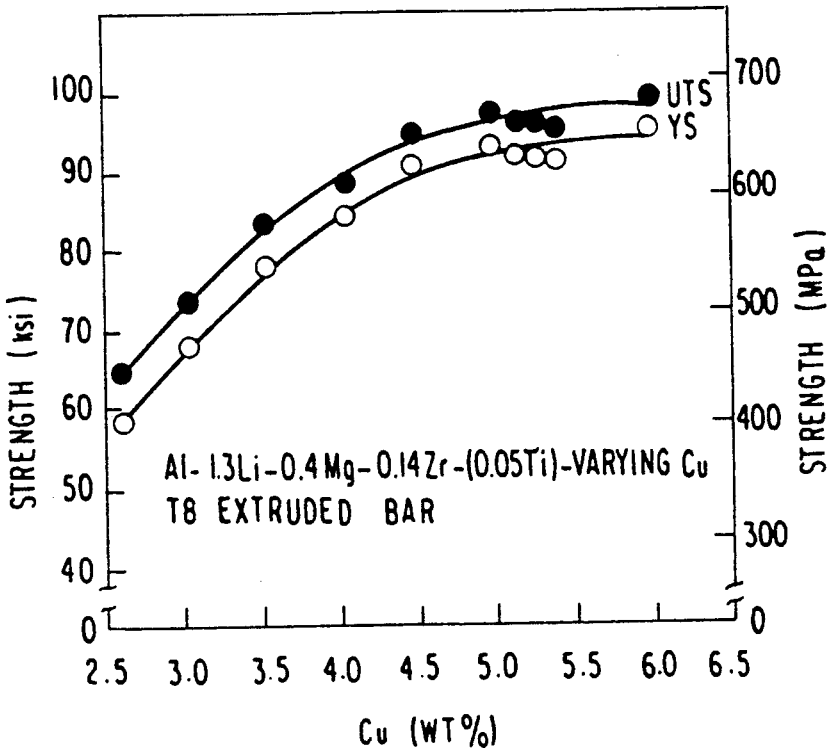
FIG. 19A shows how tensile properties vary E13 with the Cu level in Al - 1.3 Li - 0.4 Mg - 0.14 Zr - 0.05 Ti containing alloys in the T8 temper.

FIG. 16A shows that alloys of the composition Al - 1.3 Li - 0.4 Mg - 0.14 Zr - 0.05 Ti, with various amounts of Cu, have the highest naturally aged strengths between about 5 and 6 percent Cu in the T3 temper. Below about 5 percent Cu, strengths decrease gradually. FIG. 17A shows a similar tendency in the T4 temper. Similarly, the highest strengths in both the artificially aged T6 and T8 tempers are attained between about 5 and 6 percent Cu, as shown in FIGS. 18A and 19A. As in the T3 and T4 tempers, strengths decrease below about 5 percent Cu, however, the decrease is more pronounced in the T6 and T8 tempers.

Table VII lists tensile properties of alloys of the present invention comprising Al - 1.3 Li - 0.4 Mg - 0.14 Zr - 0.05 Ti, with various amounts of Cu. The weight percentages of Cu given are measured values.

TABLE VII

Tensile Properties of Alloys with Increasing Copper Content

| Comp | Cu Level (wt %) | Aging Temp (°C.) | (Time) (h) | Temper | YS (ksi) | UTS (ksi) | EL (%) |
|---|---|---|---|---|---|---|---|
| XXIV | 2.62 | — | — | T3 | 43.5 | 57.1 | 13.9 |
| | | — | — | T4 | 41.1 | 62.3 | 15.8 |
| | | 180 | (16) | T8 | 59.0 | 60.0 | 8.8 |
| | | 160 | (24) | T8 | 57.7 | 63.8 | 10.2 |
| | | 180 | (22) | T6 | 49.9 | 61.2 | 13.5 |
| XXV | 3.06 | — | — | T3 | 49.3 | 61.2 | 13.5 |
| | | — | — | T4 | 49.6 | 71.7 | 18.4 |
| | | 180 | (16) | T8 | 68.8 | 74.1 | 10.1 |
| | | 160 | (24) | T8 | 67.3 | 73.2 | 11.8 |
| | | 180 | (22) | T6 | 54.8 | 67.6 | 11.4 |
| XXVI | 3.55 | — | — | T3 | 51.7 | 66.7 | 18.1 |
| | | — | — | T4 | 45.6 | 67.5 | 15.4 |
| | | 180 | (16) | T8 | 78.3 | 83.7 | 10.2 |
| | | 160 | (24) | T8 | 77.8 | 82.8 | 12.4 |
| | | 180 | (22) | T6 | 65.3 | 75.3 | 10.9 |
| XXVII | 4.07 | — | — | T3 | 49.9 | 64.5 | 13.8 |
| | | — | — | T4 | 58.9 | 80.8 | 18.6 |
| | | | (16) | T8 | 80.1 | 85.3 | 10.9 |
| | | 160 | (24) | T8 | 88.6 | 92.0 | 11.5 |
| | | 180 | (22) | T6 | 66.8 | 75.7 | 12.0 |
| XXVIII | 4.42 | — | — | T3 | 54.6 | 72.2 | 16.1 |
| | | — | — | T4 | 60.4 | 83.8 | 17.0 |
| | | 180 | (16) | T8 | 87.0 | 91.8 | 8.0 |
| | | 160 | (16) | T8 | 95.7 | 98.7 | 9.0 |
| | | 160 | (20) | T8 | 89.3 | 93.7 | 9.6 |
| | | 180 | (22) | T6 | 82.2 | 88.4 | 7.3 |
| XXIX | 4.98 | — | — | T3 | 58.8 | 75.0 | 15.5 |
| | | — | — | T4 | 64.5 | 84.6 | 14.1 |
| | | 180 | (16) | T8 | 92.0 | 96.8 | 6.1 |
| | | 160 | (20) | T8 | 93.3 | 96.7 | 7.8 |
| | | 180 | (22) | T6 | 84.6 | 92.4 | 5.5 |
| XXX | 5.16 | — | — | T3 | 60.2 | 76.7 | 17.2 |
| | | — | — | T4 | 59.0 | 81.8 | 14.8 |
| | | 180 | (16) | T8 | 91.8 | 96.3 | 7.2 |
| | | 160 | (20) | T8 | 92.3 | 96.3 | 7.4 |
| | | 180 | (22) | T6 | 85.3 | 92.3 | 5.5 |
| XXXI | 5.30 | — | — | T3 | 61.8 | 77.3 | 14.3 |
| | | — | — | T4 | 60.7 | 83.1 | 17.2 |
| | | 180 | (16) | T8 | 90.3 | 95.8 | 7.1 |
| | | 160 | (20) | T8 | 93.0 | 96.8 | 8.3 |
| | | 180 | (22) | T6 | 81.3 | 89.5 | 5.4 |

It is noted that the above mentioned outstanding age hardening responses and high strengths achievable with the alloys of the present invention would typically be expected for alloys with very high solid solubility of precipitate forming elements. The results are thus quite unexpected in comparison to prior art Al-Cu-Li-Mg alloys, where as previously indicated, Mondolfo (p. 641) concludes that the addition of Li to Al-Cu-Mg alloys lowers the solid solubility of Cu and Mg, and the addition of Mg to Al-Cu-Li alloys lowers the solid solubility of copper and lithium and thus reduces the age hardening response and UTS values achievable. In contrast, it has been found that highly improved age hardening response and higher strengths than previously obtainable can be achieved in the alloys of the present invention.

A detailed transmission electron microscopy (TEM) study including selected area diffraction (SAD) measurements has shown that the ultrahigh strength of the alloys of the present invention in the T8 temper may be associated with the fine homogeneous distribution of $T_1$ ($Al_2CuLi$) precipitates rather than-the other strengthening precipitates, such as delta-prime ($Al_3Li$) and theta-prime ($Al_2Cu$), commonly found in Al-Li and Al-Cu-Li alloys.

In a recent study of the alloy 2090 by Huang and Ardell (see "Crystal Structure and Stability of $T_1$ ($Al_2CuLi$) Precipitates in Aged Al-Li-Cu Alloys", Mat. Sci. and Technology, March, Vol. 3, pp. 176–188, 1987), it was found that alloy 2090 in the T8 temper contains both the $T_1$ and delta-prime phases, with the $T_1$ phase being a more potent strengthener than the delta-prime phase. In contrast, a selected area diffraction pattern (SADP) study of alloys of the present invention (Composition I, T8 temper) shows that $T_1$ is the major strengthening phase present and no delta-prime is observed. This conclusion is reached by comparing selected area diffraction patterns for the [110], [112], [114], and (013] zone axes (ZA) from an alloy of Composition I in the T8 temper with the predicted patterns from Huang and Ardell. The SADP study also shows that the $T_1$ platelet volume fraction of the Composition I alloy in the T8 temper appears to be greater and more uniformly distributed than in alloy 2090 (by observation of a centered dark field (CDF) photograph taken from the (1010) $T_1$ spot with ZA - [114]). Additionally, alloy 2090 requires cold work for extensive $T_1$ precipitation to occur, while in the alloys of the present invention, high volume fractions of $T_1$ are observed in artificially aged tempers irrespective of the presence of cold work.

The alloys of the present invention resemble more closely the Al-Cu-Li system studied by Silcock (see J.M. Silcock, "The Structural Aging Characteristics of Aluminum-Copper-Lithium Alloys," J. Inst. Metals, 88, pp. 357-364, 1959-1960.) At similar copper and lithium levels, Silcock showed that the phases present in the artificially aged condition are $T_1$, theta-prime, and aluminum solid solution. Unexpectedly, in the present invention the precipitation of theta-prime is suppressed, apparently by the extensive nucleation of the $T_1$ phase, but this effect is not fully understood.

In addition to the superior room temperature properties, tests show that the alloys of the present invention possess excellent cryogenic properties. Not only are the tensile and yield strengths retained, but there is actually an improvement at low temperatures. The properties are far superior to those of alloy 2219 as shown in Table VIII. For example, Composition I in a T8 temper at −196° C. (−320° F.) displays tensile properties as high as 109 ksi YS, and 114 ksi UTS (see FIG. 20A). This has important implications for space applications where cryogenic alloys are often necessary for fuel and oxidizer tankage.

TABLE VIII

| Temperature (°F.) | Temper | YS (ksi) | UTS (ksi) | El (%) |
|---|---|---|---|---|
| | Cryogenic Properties | | | |
| | Composition I | | | |
| −80 | T3 | 63.5 | 78.4 | 14.3 |
| −320 | T3 reversion | 64.7 | 85.5 | 19.5 |
| −320 | T3 | 76.7 | 93.9 | 14.0 |
| −80 | T4 | 65.1 | 87.9 | 13.0 |
| −320 | T4 | 75.8 | 99.0 | 12.5 |
| −80 | T6 reversion | 39.8 | 65.7 | 22.0 |
| −80 | T6 under aged | 79.8 | 89.6 | 7.2 |
| −80 | T6 | 96.5 | 102.8 | 2.0 |
| −320 | T6 reversion | 47.8 | 79.0 | 25.9 |
| −320 | T6 under aged | 85.5 | 99.6 | 6.0 |
| −320 | T6 | 101.8 | 107.8 | 2.0 |
| −80 | T8 reversion | 51.8 | 69.3 | 16.1 |
| −80 | T8 underaged | 87.8 | 94.0 | 7.0 |
| −80 | T8 | 99.0 | 102.3 | 3.0 |
| −320 | T8 reversion | 64.7 | 85.5 | 19.6 |
| −320 | T8 underaged | 100.6 | 107.8 | 4.0 |
| −320 | T8 | 109.0 | 114.2 | 2.0 |
| | Composition XI | | | |
| −80 | T3 | 60.8 | 78.1 | 14.6 |
| −320 | T3 | 76.9 | 97.2 | 13.5 |
| −80 | T4 | 64.5 | 85.7 | 11.3 |
| −320 | T4 | 80.5 | 106.2 | 12.4 |
| −80 | T6 reversion | 40.6 | 64.9 | 22.3 |
| −80 | T6 under aged | 79.0 | 89.0 | 8.6 |
| −80 | T6 | 95.0 | 99.0 | 4.2 |
| −320 | T6 reversion | 44.8 | 77.9 | 28.2 |
| −320 | T6 under aged | 92.9 | 105.6 | 8.3 |
| −320 | T6 | 103.0 | 109.9 | 3.7 |
| −80 | T8 reversion | 49.7 | 69.7 | 17.6 |
| −80 | T8 under aged | 88.4 | 95.3 | 9.3 |
| −80 | T8 | 98.6 | 101.6 | 5.0 |
| −320 | T8 reversion | 58.3 | 82.7 | 19.8 |
| −320 | T8 under aged | 98.5 | 110.0 | 9.6 |
| −320 | T8 | 110.9 | 118.7 | 5.8 |
| | 2219 | | | |
| −80 | T62 | 43.0 | 62.0 | 13.0 |
| −320 | T62 | 51.0 | 74.0 | 14.0 |
| −80 | T87 | 52.0 | 71.0 | 9.5 |
| −320 | T87 | 64.0 | 84.0 | 12.0 |

The Composition I alloy also exhibits excellent elevated temperature properties. For example, in the T6 temper, with peak aging of 16 hours, it retains a large portion of its strength and a useful amount of elongation at 149° C. (300° F.), i.e. 74.4 ksi YS, 77.0 ksi UTS and 7.5 percent elongation. In the near peak aged T8 temper, Composition I at 149° C. (300° F.) has 84.7 ksi YS, 85.1 ksi UTS and 5.5 percent elongation (see Table IX and FIGS. 21A-21B).

TABLE IX

| Temperature (°F.) | Temper | YS (ksi) | UTS (ksi) | El (%) |
|---|---|---|---|---|
| | Elevated Temperature Properties | | | |
| | Composition I | | | |
| 300 | T6 | 74.4 | 77.0 | 7.5 |
| 300 | T8 | 84.7 | 85.1 | 5.5 |
| 500 | T8 | 44.5 | 45.2 | 5.5 |

Welding studies of the alloys of the present invention indicate that they are readily weldable, possessing excellent resistance to hot cracking that can occur during welding. Tungsten Inert Gas (TIG) butt welds of Composition I were made from the 10 mm×102 mm (⅜×4 inch) extruded bar using filler alloy 2319 (Al - 6.3 Cu - 0.3 Mn - 0.15 Ti - 0.1 V - 0.18 Zr). The plates were highly constrained, yet no hot cracking was observed. The welding was performed using direct current straight polarity. The punch pass parameters were 240 volts, 13.6 amps at 4.2 mm/second (10 inch/minute) travel speed. The 2319 filler (1.6 mm (1/16-inch) diameter rod) was fed into the weld at 7.6 mm/second (18 inches/minute) with 178 volts and 19 amps. A quantitative assessment of weldability is difficult to attain, but the weldability appears to be very close to that of 2219, which has a rating of "A" in MIL. HANDBOOK V, indicating that the alloy is generally weldable by all commercial procedures and methods.

Mechanical properties were measured on weldments of Composition VI with Composition VI filler and with 2319 filler, as well as Composition XI with Composition XI filler and with 2319 filler. The weld strengths from these alloys in the naturally aged condition are in several cases higher than those of 2219-T81 and 2519-T87, alloys that are generally considered to be weldable (see Table X).

TABLE X

Properties of Experimental Alloys in As Welded, Bead-off, Naturally Aged Condition

| Parent Metal Comp. | Temper Before Welding | Filler Comp. | Proc. | YS (ksi) | UTS (ksi) | El (%) |
|---|---|---|---|---|---|---|
| VI | T3 | VI | GTAW | 34.8 | 41.0 | 1.5 |
| | | | | 37.4 | 41.6 | 1.3 |
| | | | | 36.0 | 40.6 | 1.5 |
| | | | | 34.6 | 42.4 | 2.1 |
| VI | T8 | VI | GTAW | 35.1 | 41.8 | 1.9 |
| VI | T8 | 2319 | GTAW | 32.2 | 37.1 | 1.2 |
| | | | | 33.8 | 40.7 | 2.3 |
| | | | | 31.2 | 37.1 | 1.5 |
| XI | T3 | XI | GTAW | 36.8 | 47.9 | 3.7 |
| | | | | 38.9 | 50.5 | 4.4 |
| | | | | 35.6 | 49.9 | 6.3 |
| XI | T8 | XI | GTAW | 36.2 | 44.0 | 2.2 |
| | | | | 36.9 | 47.0 | 3.1 |
| | | | | 36.4 | 49.9 | 5.0 |
| XI | T8 | 2319 | GTAW | 31.0 | 43.4 | 3.9 |
| | | | | 33.0 | 45.0 | 3.9 |
| | | | | 31.8 | 40.3 | 2.6 |
| (Parent metal taken from 9.5 mm bar.) | | | | | | |
| 2519 | T87 | 2319 | GMAW | 30.3 | 43.7 | 4.4 |
| 2519 | T87 | 2319 | GMAW | 27.3 | 43.4 | 3.6 |
| (Parent Metal taken from 19 mm plate.) | | | | | | |
| 2219 | T81 | 2319 | GMAW | 26.0 | 38.0 | 3.0 |
| 2219 | T81 | 2319 | GMAW | 34.0 | 41.0 | 2.0 |

TABLE X-continued

Properties of Experimental Alloys in As Welded, Bead-off, Naturally Aged Condition

| Parent Metal Comp. | Temper Before Welding | Filler Comp. | Proc. | YS (ksi) | UTS (ksi) | El (%) |
|---|---|---|---|---|---|---|

(Parent metal taken from 9.5 mm plate.)

High strength aluminum alloys typically have low resistance to various types of corrosion, particularly stress-corrosion cracking (SCC), which has limited the usefulness of many high-tech alloys. In contrast, the alloys of the present invention show promising results from SCC tests. For Composition I, a stress vs. time-to-failure test, (ASTM standard G49, with test duration ASTM standard G64) shows that 4 LT (long transverse) specimens loaded at each of the following stress levels, 50 ksi, 37 ksi and 20 ksi, all survived the standard 40-day alternate immersion test. This is significant because it demonstrates excellent SCC resistance at stress levels approximately equal to the yield strengths of existing aerospace alloys such as 2024 and 2014. Additionally, Composition I in a T8 temper possesses SCC resistance comparable to artificially peak-aged 8090, but at a strength level 25–30 ksi higher.

The EXCO test (ASTM standard G34), a test for exfoliation susceptibility for 2XXX Al alloys, reveals that alloy Composition I has a rating of EA. This indicates only minimal susceptibility to exfoliation corrosion.

It is to be understood that the above description of the present invention is susceptible to various modifications, changes, and adaptations by those skilled in the art, and that the same are to be considered to be within the spirit and scope of the invention as set forth by the claims which follow.

We claim:

1. An aluminum-base alloy consisting essentially of from about 5.0 to 7.0 weight percent Cu, 0.1–2.5 weight percent Li, 0.05–4 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

2. An alloy according to claim 1, wherein the grain refiner comprises from about 0.05 to about 0.5 weight percent.

3. An alloy according to claim 1, wherein the grain refiner comprises from about 0.08 to about 0.2 weight percent.

4. An aluminum-base alloy consisting essentially of from 5.0 to 7.0 weight percent Cu, 0.1– 2.5 weight percent Li, 0.2 to 1.5 weight percent Mg, 0.1–1.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

5. An alloy according to claim 4, wherein the Li comprises from about 0.5 to about 2.0 weight percent.

6. An alloy according to claim 4, wherein the Li comprises from about 1.0 to about 1.4 weight percent.

7. An alloy according to claim 4, wherein the Mg comprises from about 0.3 to about 0.5 weight percent.

8. An alloy according to claim 7, wherein the Li comprises from about 0.5 to about 2.0 weight percent.

9. An alloy according to claim 7, wherein the Li comprises from about 1.0 to about 1.4 weight percent.

10. An alloy according to claim 1, wherein the grain refiner comprises Zr.

11. An alloy according to claim 1, wherein the grain refiner comprises Ti.

12. An aluminum-base alloy consisting essentially of from greater than 5.0 to 6.5 weight percent Cu, 0.1–2.5 weight percent Li, 0.05–4 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

13. An alloy according to claim 12, wherein the Mg comprises from about 0.2 to about 1.5 weight percent.

14. An alloy according to claim 13, wherein the Cu comprises from about 5.2 to about 6.5 weight percent, the Li comprises from about 0.8 to about 1.8 weight percent, and the Mg comprises from about 0.25 to about 1.0 weight percent.

15. An alloy according to claim 13, wherein the Li comprises from about 1.0 to about 1.4 weight percent.

16. An alloy according to claim 12, wherein the Mg comprises from about 0.3 to about 0.5 weight percent.

17. An alloy according to claim 16, wherein the Li comprises from about 0.5 to about 2.0 weight percent.

18. An alloy according to claim 16, wherein the Li comprises from about 1.0 to about 1.4 weight percent.

19. An alloy according to claim 12, wherein the grain refiner comprises from about 0.05 to about 0.5 weight percent.

20. An aluminum-base alloy consisting essentially of from about 5.4 to about 6.3 weight percent Cu, 0.1–2.5 weight percent Li, 0.05–4 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

21. An alloy according to claim 20, wherein the Mg comprises from about 0.2 to about 1.5 weight percent.

22. An alloy according to claim 21, wherein the Li comprises from about 0.5 to about 2.0 weight percent.

23. An alloy according to claim 21, wherein the Li comprises from about 1.0 to about 1.4 weight percent.

24. An alloy according to claim 20, wherein the Mg comprises from about 0.3 to about 0.5 weight percent.

25. An alloy according to claim 24, wherein the Li comprises from about 0.5 to about 1.7 weight percent.

26. An alloy according to claim 24, wherein the Li comprises from about 1.0 to about 1.4 weight percent.

27. An alloy according to claim 20, wherein the grain refiner comprises from about 0.08 to about 0.2 weight percent Zr.

28. An aluminum-base alloy consisting essentially of about 6.3 weight percent Cu, about 1.3 weight percent Li, about 0.4 weight percent Mg, about 0.14 weight percent Zr, and the balance Al and incidental impurities, wherein the alloy in the solution heat treated, artificially aged condition possesses an ultimate tensile strength of greater than 75 ksi.

29. An aluminum-base alloy consisting essentially of about 5.0 weight percent Cu, about 1.3 weight percent Li, about 0.4 weight percent Mg, about 0.14 weight percent Zr, and the balance Al and incidental impurities, wherein the alloy in the solution heat treated, artificially aged condition possesses an ultimate tensile strength of greater than 75 ksi.

30. An aluminum-base alloy consisting essentially of about 5.2 weight percent Cu, about 1.3 weight percent Li, about 0.4 weight percent Mg, about 0.14 weight percent Zr, and the balance Al and incidental impurities, wherein the alloy in the solution heat treated, artificially aged condition possesses an ultimate tensile strength of greater than 75 ksi.

31. An aluminum-base alloy consisting essentially of about 6.3 weight percent Cu, about 1.3 weight percent Li, about 0.6 weight percent Mg, about 0.14 weight percent Zr, and the balance Al and incidental impurities, wherein the alloy in the solution heat treated, artificially aged condition possesses an ultimate tensile strength of greater than 75 ksi.

32. An aluminum-base alloy consisting essentially of about 5.4 weight percent Cu, about 1.3 weight percent Li, about 0.4 weight percent Mg, about 0.14 weight percent Zr, and the balance Al and incidental impurities, wherein the alloy in the solution heat treated, artificially aged condition possesses an ultimate tensile strength of greater than 75 ksi.

33. An aluminum-base alloy consisting essentially of about 5.4 weight percent Cu, about 1.3 weight percent Li, about 0.4 weight percent Mg, about 0.14 weight percent Zr, about 0.3 weight percent Ti, about 0.4 weight percent Mn, and the balance Al and incidental impurities, wherein the alloy in the solution heat treated, artificially aged condition possesses an ultimate tensile strength of greater than 75 ksi.

34. An aluminum-base alloy having a composition consisting essentially of about 5.4 weight percent Cu, about 1.3 weight percent Li, about 0.4 weight percent Mg, about 0.14 weight percent Zr, about 0.25 weight percent Zn, and the balance aluminum and incidental impurities, wherein the alloy in the solution heat treated, artificially aged condition possesses an ultimate tensile strength of greater than 75 ksi.

35. An aluminum-base alloy having a composition consisting essentially of about 5.4 weight percent Cu, about 1.3 weight percent Li, about 0.4 weight percent Mg, about 0.14 weight percent Zr, about 0.2 weight percent Ge, and the balance aluminum and incidental impurities, wherein the alloy in the solution heat treated, artificially aged condition possesses an ultimate tensile strength of greater than 75 ksi.

36. An aluminum-base alloy having a composition consisting essentially of about 5.4 weight percent Cu, about 1.3 weight percent Li, about 0.4 weight percent Mg, about 0.14 weight percent Zr, about 0.1 weight percent In, and the balance aluminum and incidental impurities, the alloy in the solution heat treated, artificially aged condition possesses an ultimate tensile strength of greater than 75 ksi.

37. A solution heat treated, cold worked, artificially aged aluminum-base alloy consisting essentially of from about 5.0 to about 7.0 weight percent Cu, 0.1–2.5 weight percent Li, 0.5–4 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, which alloy possesses strengthening precipitates consisting essentially of $Al_2CuLi$, and an ultimate tensile strength of greater than 80 ksi.

38. An aluminum-base alloy consisting essentially of 3.5–7.0 weight percent Cu, 0.8–1.8 weight percent Li, from about 0.25 to about 1.0 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

39. An alloy according to claim 38, wherein the grain refiner comprises from about 0.05 to about 0.5 weight percent.

40. An alloy according to claim 38, wherein the grain refiner comprises from about 0.08 to about 0.2 weight percent.

41. An alloy according to claim 38, wherein the grain refiner comprises Zr, Ti, or a combination thereof.

42. An aluminum-base alloy consisting essentially of 3.5–7.0 weight percent Cu, from about 1.0 to about 1.4 weight percent Li, from about 0.3 to about 0.5 weight percent Mg, from about 0.05 to about 0.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

43. An alloy according to claim 42, wherein the grain refiner comprises from about 0.08 to about 0.2 weight percent.

44. An alloy according to claim 42, wherein the grain refiner comprises Zr, Ti or a combination thereof.

45. An aluminum-base alloy consisting essentially of from about 4.0 to about 6.5 weight percent Cu, from about 1.0 to about 1.4 weight percent Li, from about 0.3 to about 0.5 weight percent Mg, from about 0.08 to about 0.2 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

46. An alloy according to claim 45, wherein the grain refiner comprises Zr, Ti, or a combination thereof.

47. An aluminum-base alloy consisting essentially of from about 4.5 to about 6.3 weight percent Cu, from about 1.0 to about 1.4 weight percent Li, from about 0.3 to about 0.5 weight percent Mg, from about 0.08 to about 0.2 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

48. An alloy according to claim 47, wherein the grain refiner comprises Zr, Ti, or a combination thereof.

49. A method of producing an aluminum-base alloy product having a composition consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, the product possessing an ultimate tensile strength of greater than 80 ksi, said method comprising the steps of casting the alloy, homogenizing the alloy, working the alloy to form a product, solution heat treating the product, cold working the product, and artificially aging the product.

50. The method according to claim 49, wherein working of the alloy to form a product is accomplished by extruding.

51. The method according to claim 49, wherein the Cu comprises from about 5.0–7.0 weight percent.

52. A solution heat treated, cold worked, artificially aged aluminum-base alloy consisting essentially of 3.5–7.0 weight percent Cu, 0.8–1.8 weight percent Li, from about 0.25 to about 1.0 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, which alloy possesses strengthening precipitates consisting essentially of $Al_2CuLi$, and an ultimate tensile strength of greater than 80 ksi.

53. A solution heat treated, cold worked, naturally aged aluminum-base alloy consisting essentially of from about 4.5 to about 7.0 weight percent Cu, from about 1.0 to about 1.4 weight percent Li, from about 0.3 to about 0.5 weight percent Mg, from about 0.01 to about 1.5 weight percent grain refiner selected from the group consisting of Zr, Cr, Mn, Ti, Hf, V, Nb, B, $TiB_2$, and mixtures thereof, the balance aluminum and incidental impurities, which in the T3 temper possesses a yield strength in the range of rom about 55 to about 65 ksi, an ultimate tensile strength in the range of from about 70 to about 80 ksi, and an elongation in the range of from about 12 to about 20 percent.

54. A solution heat treated, naturally aged aluminum-base alloy consisting essentially of from about 4.5 to about 7.0 weight percent Cu, from about 1.0 to about 1.4 weight percent Li, from about 0.3 to about 0.5 weight percent Mg, from about 0.01 to about 1.5 weight percent grain refiner selected from the group consisting of Zr, Cr, Mn, Ti, Hf, V, Nb, B, $TiB_2$, and mixtures thereof, the balance aluminum and incidental impurities, which in the T4 temper possesses a yield strength in the range of from about 56 to about 68 ksi, an ultimate tensile strength in the range of from about 80 to about 90 ksi, and an elongation in the range of from about 12 to about 20 percent.

55. A solution heat treated, artificially aged aluminum-base alloy consisting essentially of from about 4.5 to about 7.0 weight percent Cu, from about 1.0 to about 1.4 weight percent Li, from about 0.3 to about 0.5 weight percent Mg, from about 0.01 to about 1.5 weight percent grain refiner selected from the group consisting of Zr, Cr, Mn, Ti, Hf, V, Nb, B, $TiB_2$, and mixtures thereof, the balance aluminum and incidental impurities, which in the T6 temper possesses a yield strength in the range of from about 80 to about 90 ksi, an ultimate tensile strength in the range of from about 85 to about 105 ksi, and an elongation in the range of from about 2 to about 20 percent.

56. A solution heat treated, cold worked, artificially aged aluminum-base alloy consisting essentially of from about 4.5 to about 7.0 weight percent Cu, from about 1.0 to about 1.4 weight percent Li, from about 0.3 to about 0.5 weight percent Mg, from about 0.01 to about 1.5 weight percent grain refiner selected from the group consisting of Zr, Cr, Mn, Ti, Hf, V, Nb, B, $TiB_2$, and mixtures thereof, the balance aluminum and incidental impurities, which in the T8 temper possesses a yield strength in the range of from about 88 to about 100 ksi, an ultimate tensile strength in the range of from about 88 to about 105 ksi, and an elongation in the range of from about 2 to about 10 percent.

57. A weldable aluminum-base alloy resistant to hot cracking consisting essentially of 3.5–7.0 weight percent Cu, 0.8–1.8 weight percent Li, from about 0.25 to about 1.0 weight percent Mg, 0.01–1.5 weight percent grain refiner selected from the group consisting of Zr, Cr, Ti, Hf, V, Nb, B, $TiB_2$, and mixtures thereof, the balance aluminum and incidental impurities.

58. A weldable alloy according to claim 57, wherein the Cu comprises from about 4.0 to about 7.0 weight percent.

59. A weldable alloy according to claim 57, wherein the Cu comprises from about 4.5 to about 7.0 weight percent.

60. An aluminum-base alloy consisting essentially of 3.5 to about 5.0 weight percent Cu, 0.8–1.8 weight percent Li, from about 0.25 to about 1.0 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

61. An alloy according to claim 60, wherein the weight percent ratio of Cu to Li is greater than about 2.5.

62. An alloy according to claim 60, wherein the weight percent ratio of Cu to Li is greater than about 3.0.

63. An alloy according to claim 60, wherein the grain refiner comprises from about 0.05 to about 0.5 weight percent.

64. An alloy according to claim 60, wherein the grain refiner comprises from about 0.08 to about 0.2 weight percent.

65. An alloy according to claim 60, wherein the grain refiner comprises Zr, Ti, or a combination thereof.

66. An aluminum-base alloy consisting essentially of 3.5 to about 5.0 weight percent Cu, from about 1.0 to about 1.4 weight percent Li, from about 0.3 to about 0.5 weight percent Mg, from about 0.05 to about 0.5 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

67. An alloy according to claim 66, wherein the weight percent ratio of Cu to Li is greater than about 3.0

68. An alloy according to claim 66, wherein the grain refiner comprises from about 0.08 to about 0.2 weight percent.

69. An alloy according to claim 66, wherein the grain refiner comprises Zr, Ti or a combination thereof.

70. An aluminum-base alloy consisting essentially of from about 4.0 to about 5.0 weight percent Cu, from about 1.0 to about 1.4 weight percent Li, from about 0.3 to about 0.5 weight percent Mg, from about 0.08 to about 0.2 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

71. An alloy according to claim 70, wherein the grain refiner comprises Zr, Ti, or a combination thereof.

72. An aluminum-base alloy consisting essentially of from about 4.5 to about 5.0 weight percent Cu, from about 1.0 to about 1.4 weight percent Li, from about 0.3 to about 0.5 weight percent Mg, from about 0.08 to about 0.2 weight percent grain refiner selected from the group consisting of Zr, Cr, Mn, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

73. An alloy according to claim 72, wherein the grain refiner comprises Zr, Ti, or a combination thereof.

74. A solution heat treated, cold worked, artificially aged aluminum-base alloy consisting essentially of 3.5 to about 5.0 weight percent Cu, 0.8–1.8 weight percent Li, from about 0.25 to about 1.0 weight percent Mg, 0.01–1.5 weight percent grain refiner selected from the group consisting of Zr, Cr, Mn, Ti, Hf, V, Nb, B, $TiB_2$, and mixtures thereof, the balance aluminum and incidental impurities, which alloy possesses strengthening precipitates consisting essentially of $Al_2CuLi$, and an ultimate tensile strength of greater than 80 ksi.

75. A weldable aluminum-base alloy resistant to hot cracking consisting essentially of 3.5 to about 5.0 weight percent Cu, 0.8–1.8 weight percent Li, from about 0.25 to about 1.0 weight percent Mg, 0.01–1.5 weight percent grain refiner selected from the group consisting of Zr, Cr, Ti, Hf, V, Nb, B, $TiB_2$, and mixtures thereof, the balance aluminum and incidental impurities.

76. A weldable alloy according to claim 75, wherein the Cu comprises from about 4.0 to about 5.0 weight percent.

77. A weldable alloy according to claim 75, wherein the Cu comprises from about 4.5 to about 5.0 weight percent.

78. A cryogenic aluminum-base alloy consisting essentially of 3.5 to about 5.0 weight percent Cu, 0.8–1.8 weight percent Li, from about 0.25 to about 1.0 weight percent Mg, 0.01–1.5 weight percent grain refiner selected from the group consisting of Zr, Cr, Ti, Hf, V, Nb, B, $TiB_2$, and mixtures thereof, the balance aluminum and incidental impurities, wherein the alloy in the solution heat treated, artificially aged condition possesses an ultimate tensile strength of greater than 75 ksi.

79. A welding alloy consisting essentially of:
(a) from about 5.0 to about 7.0 wt. % Cu;
(b) from about 0.05 to about 4 wt. % Mg;
(c) from about 0.1 to about 2.5 wt. % Li; and
(d) from about 0.1 to about 1.5 wt. % of a material selected from Zr, Cr, Mn, Ti, Hf, V, Nb, B, $TiB_2$, and combinations thereof,
(e) the balance consisting essentially of aluminum.

80. The welding alloy of claim 79 wherein the lithium content is from 1.0 to about 1.4 wt. %.

81. The welding alloy of claim 79 wherein the magnesium content ranges from 0.3 to about 0.5 wt. %.

82. The welding alloy of claim 79 wherein its copper content is from about 5.4 to about 6.3 wt. %.

83. A welding alloy consisting essentially of:
(a) from about 5.0 to about 6.5 wt. % Cu;
(b) from about 0.2 to about 1.5 wt. % Mg;
(c) from about 0.5 to about 1.7 wt. % Li; and
(d) from about 0.01 to about 0.5 wt. % of a material selected from Zr, Cr, Mn, Ti, Hf, V, Nb, B, $TiB_2$, and combinations thereof,
(e) the balance consisting essentially of aluminum.

84. The welding alloy of claim 83 wherein the lithium content is from 1.0 to about 1.4 wt. %.

85. The welding alloy of claim 83 wherein the magnesium content ranges from 0.3 to about 0.5 wt. %.

86. The welding alloy of claim 83 wherein its copper content is from about 5.4 to about 6.3 wt. %.

87. A welding alloy consisting essentially of:
(a) from about 5.4 to about 6.3 wt. % Cu;
(b) from about 0.3 to about 0.5 wt. % Mg;
(c) from about 1.0 to about 1.4 wt. % Li; and
(d) from about 0.08 to about 0.2 wt. % of a material selected from Zr, Cr, Mn, Ti, Hf, V, Nb, B, $TiB_2$, and combinations thereof,
(e) the balance consisting essentially of aluminum.

88. An alloy according to claim 1, wherein the alloy in the solution heat treated, artificially aged condition possesses an ultimate tensile strength of greater than 80 ksi.

89. An alloy according to claim 1, wherein the alloy in the solution heat treated, cold worked, artificially aged condition possesses an ultimate tensile strength of greater than 80 ksi.

90. An alloy according to claim 89, wherein the alloy in the solution heat treated, cold worked, artificially aged condition possesses an elongation of greater than about 5 percent.

91. An alloy according to claim 38, wherein the alloy in the solution heat treated, cold worked, artificially aged condition possesses an ultimate tensile strength of greater than 80 ksi.

92. An alloy according to claim 91, wherein the alloy in the solution heat treated, cold worked, artificially aged condition possesses an elongation of greater than about 5 percent.

93. A solution heat treated, cold worked, naturally aged aluminum-base alloy consisting essentially of from about 5.0–7.0 weight percent Cu, 0.1–2.5 weight percent Li, 0.05–4 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, said alloy possessing an ultimate tensile strength of greater than 60 ksi.

94. A solution heat treated, naturally aged aluminum-base alloy consisting essentially of from about 5.0–7.0 weight percent Cu, 0.1–2.5 weight percent Li, 0.05–4 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, said alloy possessing an ultimate tensile strength of greater than 65 ksi.

95. A solution heat treated, artificially aged aluminum-base alloy consisting essentially of from about 5.0–7.0 weight percent Cu, 0.1–2.5 weight percent Li, 0.5–4 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, said alloy possessing an ultimate tensile strength of greater than 75 ksi.

96. A solution heat treated, cold worked, artificially aged aluminum-base alloy consisting essentially of from about 5.0–7.0 weight percent Cu, 0.1–2.5 weight percent Li, 0.05–4 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, said alloy possessing an ultimate tensile strength of greater than 80 ksi.

97. A solution heat treated, cold worked, naturally aged aluminum-base alloy consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance Al and incidental impurities, said alloy possessing an ultimate tensile strength of greater than 60 ksi.

98. A solution heat treated, naturally aged aluminum-base alloy consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance Al and incidental impurities, said alloy possessing an ultimate tensile strength of greater than 65 ksi.

99. A solution heat treated, artificially aged aluminum-base alloy consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance Al and incidental impurities, said alloy possessing an ultimate tensile strength of greater than 75 ksi.

100. A solution heat treated, cold worked, artificially aged aluminum-base alloy consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance Al and incidental impurities, said alloy possessing an ultimate tensile strength of greater than 80 ksi.

101. An aluminum-base welding filler alloy resistant to hot cracking consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities.

102. A welding filler alloy according to claim 101, wherein the Cu comprises from about 4.5 to about 7.0 weight percent.

103. A method of producing an aluminum-base alloy product having a composition consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, the product possessing an ultimate tensile strength of greater than 60 ksi, said method comprising the steps of casting the alloy, homogenizing the alloy, working the alloy to form a product, solution heat treating the product, cold working the product, and naturally aging the product.

104. The method according to claim 103, wherein working of the alloy to form a product is accomplished by extruding.

105. The method according to claim 103, wherein the Cu comprises from about 5.0–7.0 weight percent.

106. A method of producing an aluminum-base alloy product having a composition consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, the product possessing an ultimate tensile strength of greater than 65 ksi, said method comprising the steps of casting the alloy, homogenizing the alloy, working the alloy to form a product, solution heat treating the product, and naturally aging the product.

107. The method according to claim 106, wherein working of the alloy to form a product is accomplished by extruding.

108. The method according to claim 106, wherein the Cu comprises from about 5.0–7.0 weight percent.

109. A method of producing an aluminum-base alloy product having a composition consisting essentially of 3.5–7.0 weight percent Cu, 0.8–1.8 weight percent Li, from about 0.25 to about 1.0 weight percent Mg, from about 0.01 to about 1.5 weight percent grain refiner selected from the group consisting of Zr, Cr, Mn, Ti, Hf, V, Nb, B, $TiB_2$, and combinations thereof, the balance aluminum and incidental impurities, the product possessing an ultimate tensile strength of greater than 75 ksi, said method comprising the steps of casting the alloy, homogenizing the alloy, working the alloy to form a product, solution heat treating the product, and artificially aging the product.

110. The method according to claim 109, wherein working of the alloy to form a product is accomplished by extruding.

111. The method according to claim 109, wherein the Cu comprises from about 5.0–7.0 weight percent.

* * * * *

UNITED STATES PATENT AND TRADEMARK OFFICE

CERTIFICATE OF CORRECTION

PATENT NO. : 5,259,897

DATED : November 9, 1993

INVENTOR(S) : Joseph R. Pickens et al.

It is certified that error appears in the above-identified patent and that said Letters Patent is hereby corrected as shown below:

Column 5, line 29, change "Sodiete" to --Societe--.

Figure 5B:
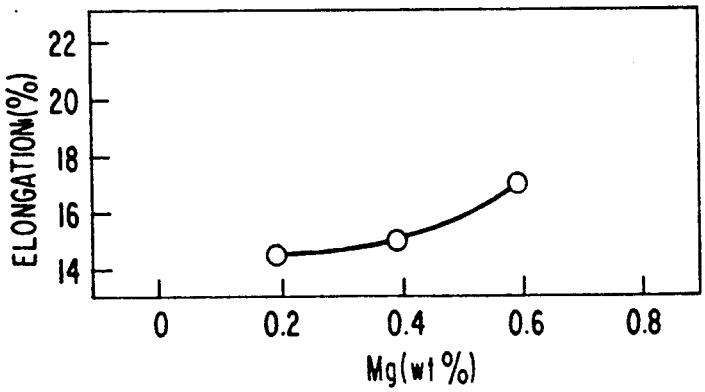

Column 11, line 13, delete "E1" and insert therefor --,and Fig. 5B how elongation varies,--.

Figure 6B:
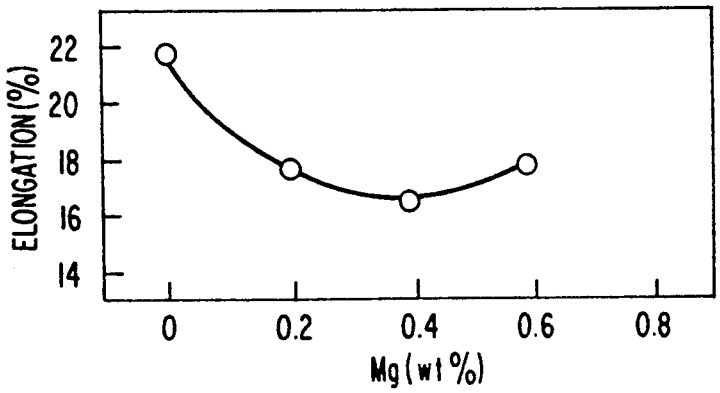

Column 11, line 16, delete "E2" and insert therefor --, and Fig. 6B how elongation varies,--.

Figure 7B:
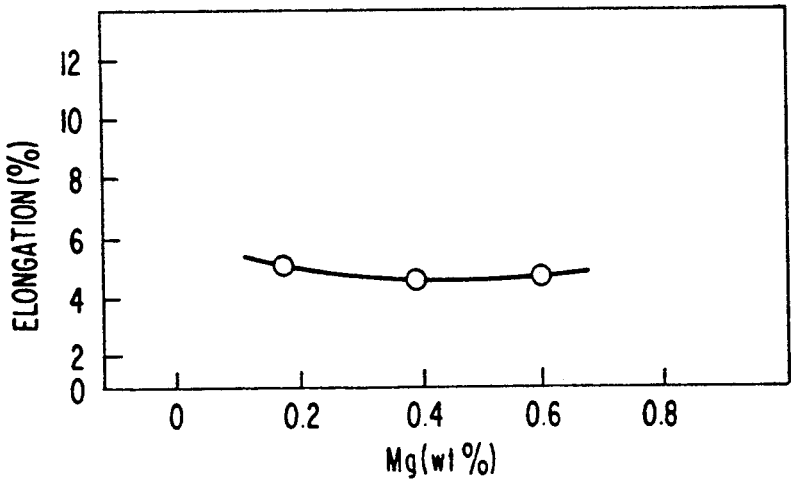

Column 11, line 19, delete "E3" and insert therefor --, and Fig. 7B how elongation varies,--.

Figure 8B:
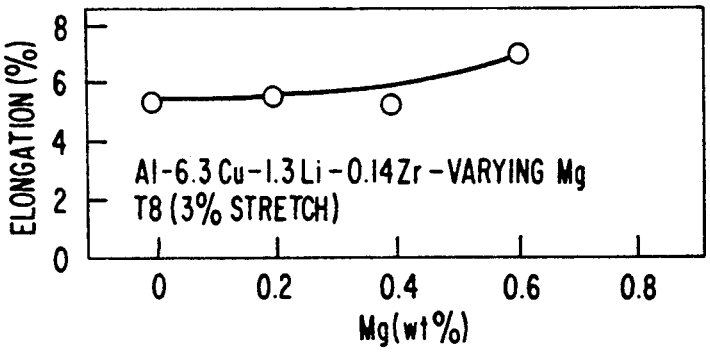

Column 11, line 22, delete "E4" and insert therefor --, and Fig. 8B how elongation varies,--.

Figure 9B:
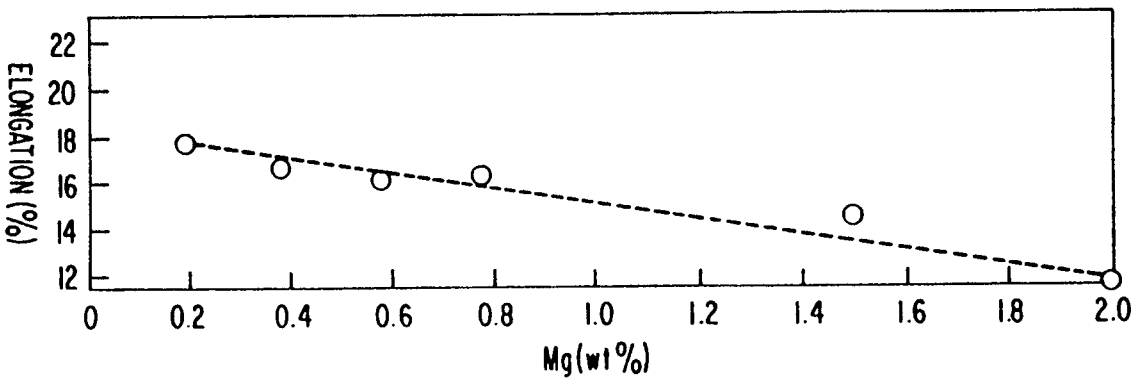

Column 11, line 25, delete "E5" and insert therefor --, and Fig. 9B how elongation varies,--.

Figure 10B:
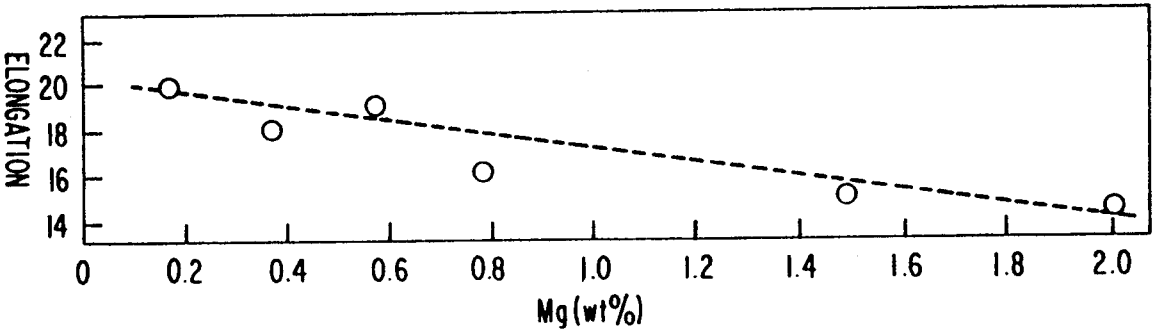

Column 11, line 28, delete "E6" and insert therefor --, and Fig. 10B how elongation varies,--.

Figure 11B:
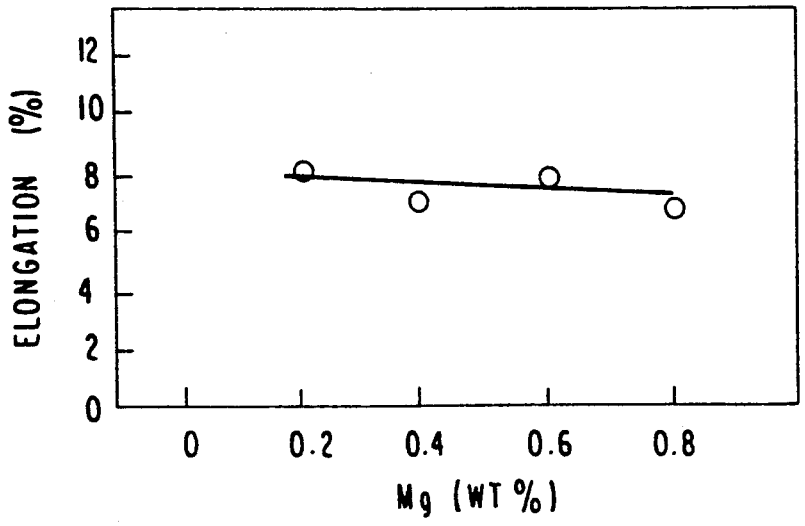

Column 11, line 31, delete "E7" and insert therefor --, and Fig. 11B how elongation varies,--.

UNITED STATES PATENT AND TRADEMARK OFFICE

CERTIFICATE OF CORRECTION

PATENT NO. : 5,259,897
DATED : November 9, 1993
INVENTOR(S) : Joseph R. Pickens et al.

Figure 12B:
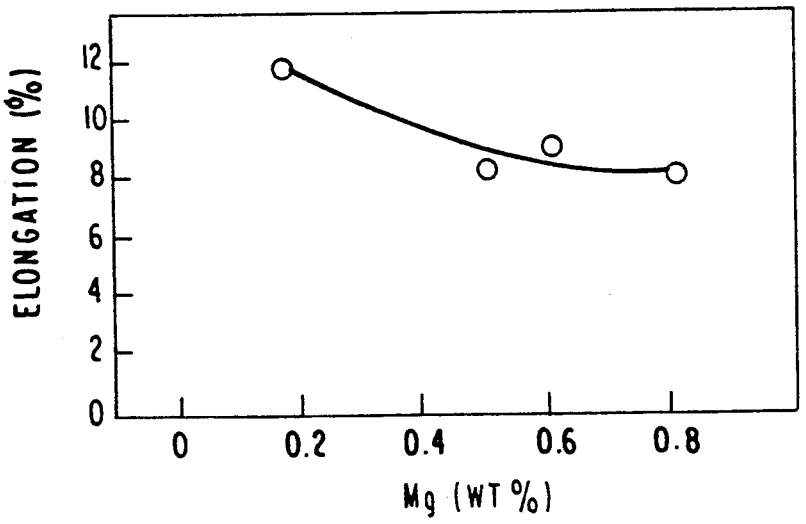

It is certified that error appears in the above-identified patent and that said Letters Patent is hereby corrected as shown below:

Column 11, line 34, delete "E8" and insert therefor --, and Fig. 12B how elongation varies,--.

Figure 13B:
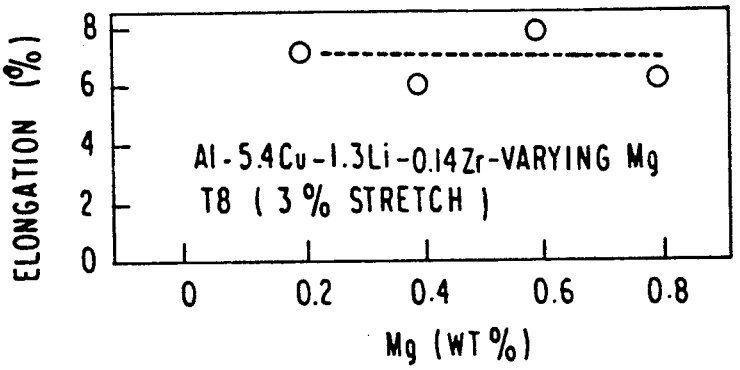

Column 11, line 37, delete "E9" and insert therefor --, and Fig. 13B how elongation varies,--.

Figure 16B:
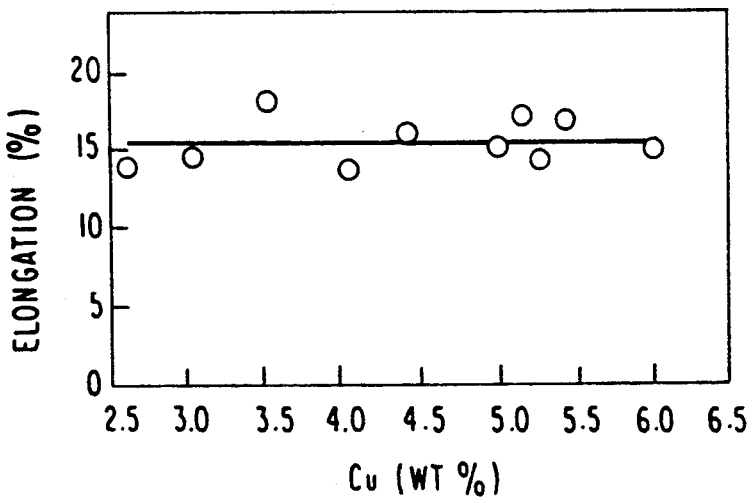

Column 11, line 46, delete "E10" and insert therefor --, and Fig. 16B how elongation varies,--.

Figure 17B:
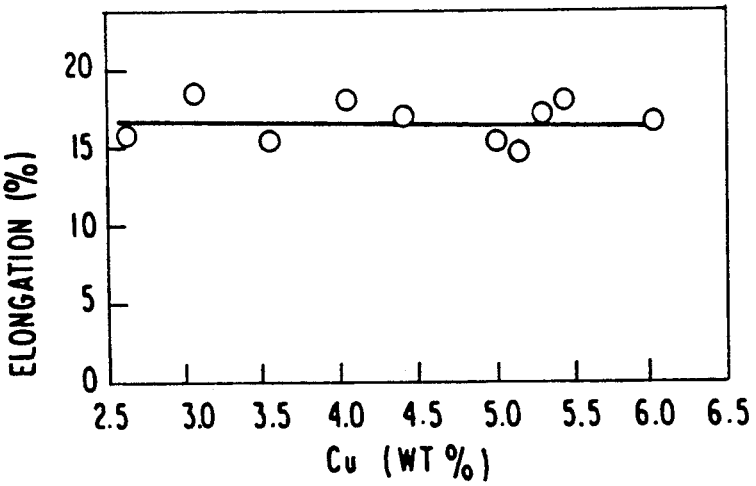

Column 11, line 49, delete "E11" and insert therefor --, and Fig. 17B how elongation varies,--.

Figure 18B:
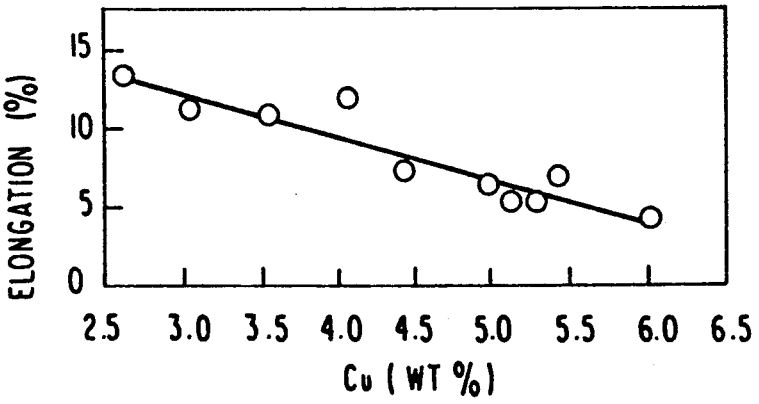

Column 11, line 52, delete "E12" and insert therefor --, and Fig. 18B how elongation varies,--.

Figure 19B:
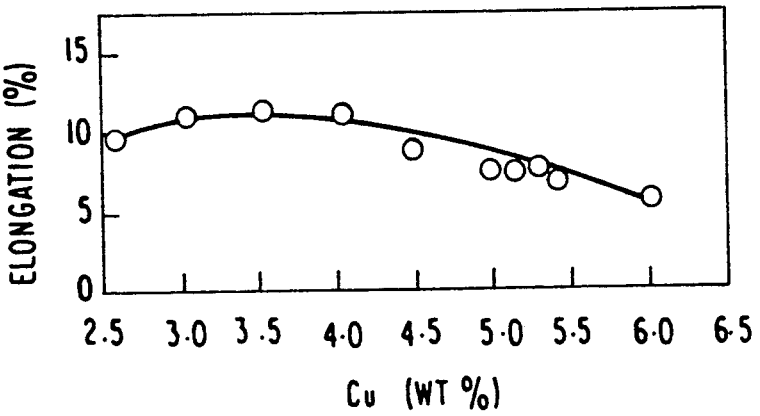

Column 11, line 55, delete "E13" and insert therefor --, and Fig. 19B how elongation varies,--.

Figure 20A:
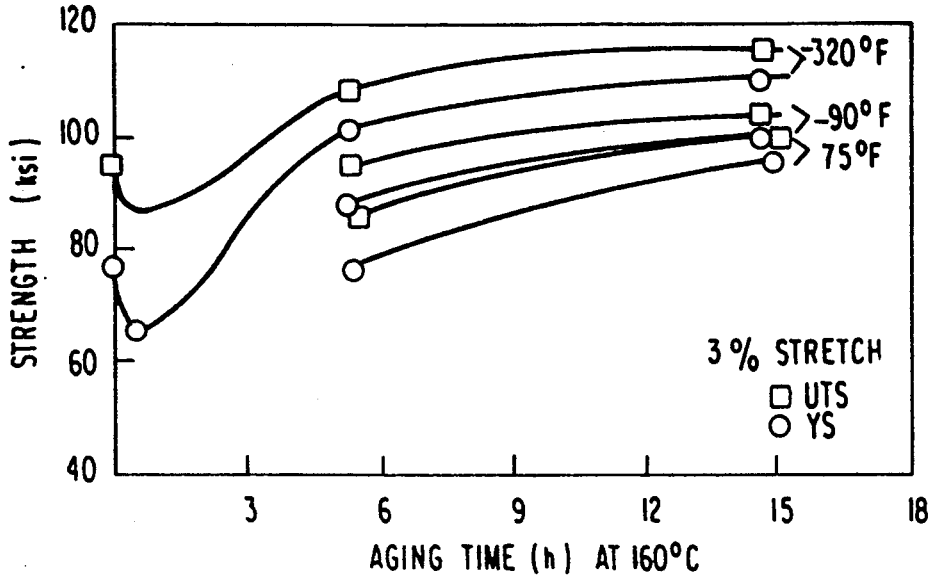
Figure 20B:
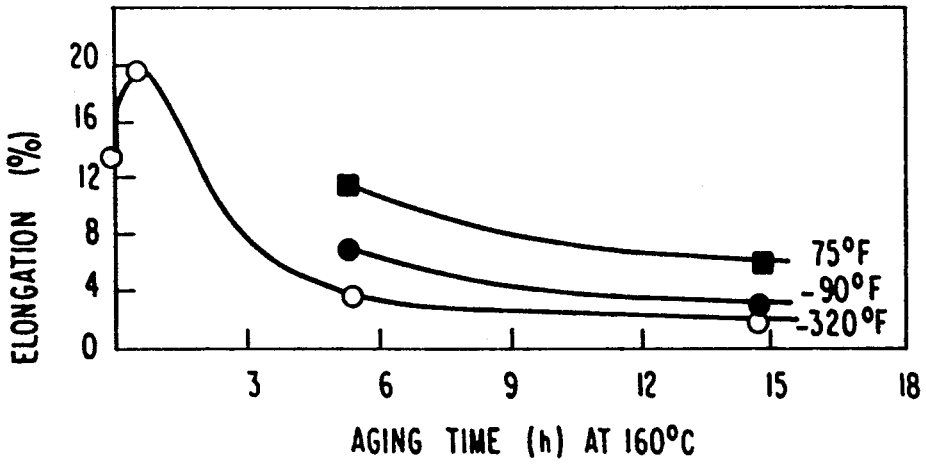

Column 11, line 58, delete "E14" and insert therefor --Figs. 20A and 20B show, respectively,--.

UNITED STATES PATENT AND TRADEMARK OFFICE

CERTIFICATE OF CORRECTION

PATENT NO. : 5,259,897
DATED : November 9, 1993
INVENTOR(S) : Joseph R. Pickens et al.

Figure 21A:
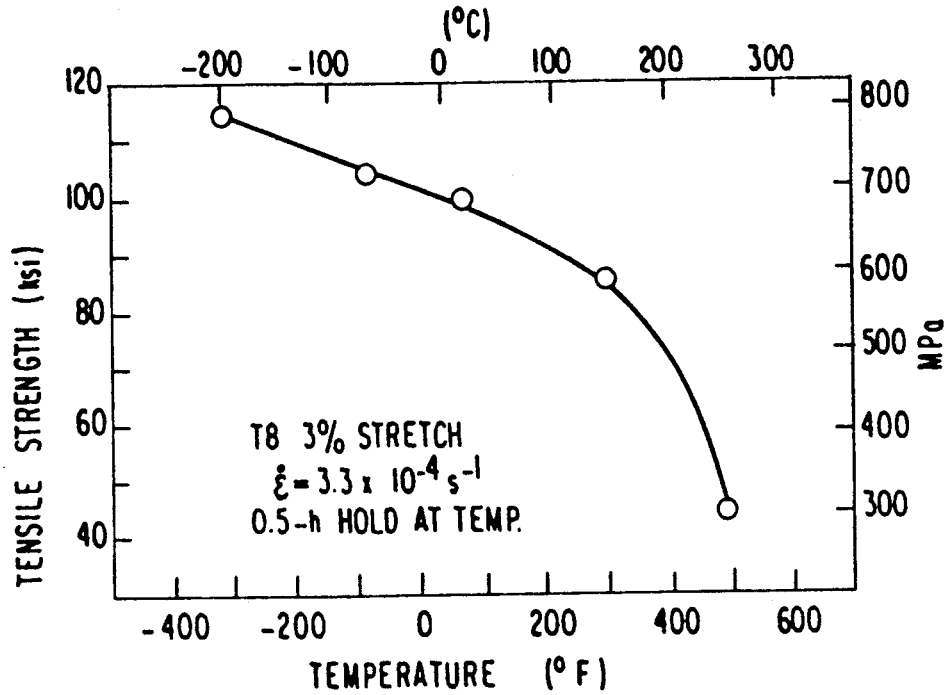
Figure 21B:
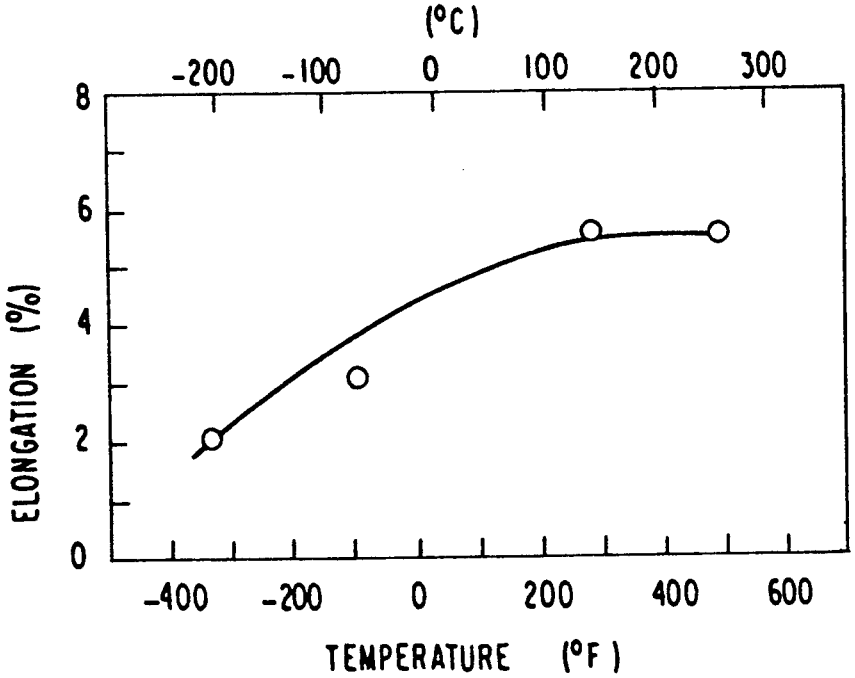

It is certified that error appears in the above-identified patent and that said Letters Patent is hereby corrected as shown below:

Column 11, line 60, delete "E15" and insert therefor --Figs. 21A and 21B show, respectively,--.

Column 12, line 48, above solid line insert the following table heading:

--TABLE 1A
COMPOSITIONS
(LOW COPPER RANGE)--

Column 15, line 30, change "m" to --mm--.

Column 17, line 28, change "a" to --5--.

Column 21, Table VII, line 18, in the column titled "Aging Temp. (°C.)", insert --180--.

Column 25, claim 4, line 56, change "0.1" to --0.01--.

Column 26, claim 19, line 35, after "percent" insert --Zr--.

Column 27, claim 33, line 30, change "0.3" to --0.03--.

Column 27, claim 37, line 62, change "0.5" to --0.05--.

UNITED STATES PATENT AND TRADEMARK OFFICE

CERTIFICATE OF CORRECTION

PATENT NO. : 5,259,897

DATED : November 9, 1993

INVENTOR(S) : Joseph R. Pickens et al.

It is certified that error appears in the above-identified patent and that said Letters Patent is hereby corrected as shown below:

Column 29, claim 53, line 27, change "rom" to --from--.

Column 29, claim 55, line 57, change "20" to --10--.

Column 31, claim 79, line 49, change "0.1" to --0.01--.

Column 32, claim 95, line 54, change "0.5" to --0.05--.

Signed and Sealed this

Thirtieth Day of August, 1994

*Attest:*

*Attesting Officer*

Bruce Lehman

BRUCE LEHMAN

*Commissioner of Patents and Trademarks*